US006427336B1

(12) United States Patent
Kojima et al.

(10) Patent No.: US 6,427,336 B1
(45) Date of Patent: Aug. 6, 2002

(54) CLAMPING MEMBER DISASSEMBLING DEVICE AND ATTACHMENT STRUCTURE THEREOF, AS WELL AS CLAMPING MEMBER DISASSEMBLING METHOD AND PRODUCTION SYSTEM USING THE METHOD

(75) Inventors: Takao Kojima; Yuichi Jibiki, both of Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/450,947

(22) Filed: Nov. 29, 1999

(30) Foreign Application Priority Data

Nov. 27, 1998 (JP) ..... 10-337715
Oct. 7, 1999 (JP) ..... 11-286759

(51) Int. Cl.[7] ..... B26B 17/00

(52) U.S. Cl. ..... 30/180; 29/426.4; 29/261; 30/228

(58) Field of Search ..... 29/426.5, 413, 29/414, 426.4, 261, 262, 265; 408/84, 112; 30/180, 228

(56) References Cited

U.S. PATENT DOCUMENTS 2,836,888 A * 6/1958 Hargrove
3,620,635 A * 11/1971 DalBianco
4,489,471 A * 12/1984 Gregory
5,253,554 A * 10/1993 Riera et al.
6,240,614 B1 * 6/2001 Kojima et al. ..... 29/268

FOREIGN PATENT DOCUMENTS

JP 3-31467 7/1991

OTHER PUBLICATIONS

U.S. application No. 09/450,947, filed Nov. 29, 1999, pending.
U.S. application No. 09/636,733, filed Aug. 11, 2000, pending.
U.S. application No. 09/636,469, filed Aug. 11, 2000, pending.

* cited by examiner

*Primary Examiner*—David P. Bryant
*Assistant Examiner*—Steven Blount
(74) *Attorney, Agent, or Firm*—Oblon, Spivak, McClelland, Maier & Neustadt, P.C.

(57) ABSTRACT

A clamping member disassembling device is disclosed in which a clamping member comprising a head portion and a body portion and clamped to base metals, with the body portion being inserted into clamping holes formed in the base metals and the head portion being in contact with a peripheral edge portion of the clamping hole in one of the base metals, is disassembled from the base metals. The disassembling device comprises a cutting means for cutting off the body portion of the clamping member in a direction nearly perpendicular to an axial direction of the body portion, a moving means which causes the cutting means to advance and retreat in the axial direction of the body portion, and a motion changing means which actuates the cutting means in a direction nearly perpendicular to the axial direction of the body portion with an advancing or retreating motion of the cutting means which motion is induced by the moving means.

32 Claims, 20 Drawing Sheets

CLAMPING MEMBER DISASSEMBLING DEVICE AND ATTACHMENT STRUCTURE THEREOF, AS WELL AS CLAMPING MEMBER DISASSEMBLING METHOD AND PRODUCTION SYSTEM USING THE METHOD

BACKGROUND OF THE INVENTION

1. Field of the Invention

The present invention relates to a clamping member disassembling device and method for disassembling a clamping member from base metals, the clamping member comprising a head portion and a body portion being inserted into clamping holes formed in the base metals, the head portion being in contact with a peripheral edge portion of one of the clamping holes, the clamping member thus clamping the base metals, as well as an attachment structure thereof and a production system using the disassembling method.

2. Description of the Related Art

As techniques for joining base metals such as steel plates or plastic plates or for connecting another member to such a base metal there are known such techniques as welding, bonding, and mechanical clamping.

The welding technique is advantageous in that the bonding strength is high, but is disadvantageous in that a large-scaled and expensive equipment is required and that a large space is needed for ensuring safety.

The bonding technique, in comparison with the welding technique, is advantageous in that the cost is low and that the bonding work can be done in a small space, but is disadvantageous in that it is necessary to keep the posture of base metals constant until an adhesive used solidifies, thus requiring a long time for bonding.

In the case of welding or bonding, when bonded base metals are not bonded to a satisfactory extent and are therefore to be re-bonded or when base metals are to be recycled, it is very difficult to disassemble the base metals from the bonded portion without any damage to the base metals.

On the other hand, as to mechanical clamping, various clamping techniques are known. Screw clamping, pin clamping and rivet clamping are mentioned as typical mechanical clamping techniques.

As to screw clamping there are known, for example, such a method as shown in FIG. 18(*a*) in which a bolt 3 as a clamping member inserted into clamping holes 1*a* and 2*a* formed in base metals 1 and 2 and a nut 4 as a clamping member engaged threadedly with the bolt 3 are tightened using a spanner to join the base metals 1 and 2 mechanically and such a method as shown in FIG. 18(*b*) in which, with use of a screw-driver, a tapping screw 5 as a clamping member is brought into threaded engagement with threads formed in clamping holes 1*a* and 2*a* of base metals 1 and 2, to clamp the base metals, thereby joining the base metals mechanically.

As to pin clamping there are known, for example, such a method as shown in FIG. 19(*a*) in which a pin 6 as a clamping member is inserted into clamping holes 1*a* and 2*a* and is then caulked at both ends thereof by means of a caulking machine or a caulking tool to join base metals 1 and 2 mechanically and such a method as shown in FIG. 19(*b*) in which a shaft 7 as a clamping member is inserted into a clamping hole of a base metal 1 and is then caulked at an end portion thereof by means of a caulking machine or a caulking tool to connect the shaft 7 to the base metal 1 mechanically.

As to rivet clamping there are known a method in which a solid rivet 8 as a clamping member shown in FIG. 20(*a*) and a tubular rivet 9 as a clamping member shown in FIG. 20(*b*) are each inserted into clamping holes 1*a* and 2*a* of base metals 1 and 2 and are then squeezed at respective end portions to connect the base metals with each other mechanically and a method in which a blind rivet 10 as a clamping member shown in FIG. 20(*c*) is inserted into clamping holes 1*a* and 2*a* of base metals 1 and 2 and is then squeezed at an end portion thereof using a mandrel which will be described later to connect the base metals 1 and 2 with each other mechanically, as shown in FIG. 20(*f*).

The blind rivet 10, as shown in FIG. 20(*c*), comprises a rivet body 11 and a mandrel 12 inserted into an axial hole 11*a* of the rivet body 11. For example, base metals 1 and 2 are clamped together mechanically in accordance with the following procedure.

According to this rivet clamping method, first a body portion 11*b* of the blind rivet 11 is inserted into clamping holes 1*a* and 2*a* of base metals 1 and 2, as shown in FIG. 21(*a*), and a blind rivet clamping device 13 is set at an end portion of the mandrel 12, as shown in FIG. 21(*b*).

Then, as shown in FIG. 21(*c*), a nose piece 13*a* of the blind rivet clamping device 13 is brought into close contact with a head portion 11*c* of the rivet body 11 and the blind rivet clamping device 13 is triggered while the head portion 11*c* is pushed against the base metal 1 by the nose piece 13*a*.

As a result, the mandrel 12 is gripped by a jaw member 13*b* as a clamp shaft gripping member of the blind rivet clamping device 13 and is pulled in the direction opposite to the pushing direction, then the portion of the body portion 11*b* projecting from the back side of the base metal 2 is deformed plastically and squeezed and is caulked into pressure contact with the base metal 2.

In this state, if the jaw member 13*b* is further pulled in the direction opposite to the pushing direction, the mandrel 12 will be broken at a reduced-diameter portion 12*b* thereof, so that the base metals 1 and 2 are clamped together by the blind rivet 10, as shown in FIG. 21(*d*).

In this clamping work using the blind rivet 10, the mandrel is thus pulled in the direction opposite to the pushing direction and therefore, as shown in FIGS. 21(*a*) to 21(*d*), the clamping work for the base metals 1 and 2 can be carried out without supporting the back side of the base metals. Thus, this method is suitable for clamping the base metals 1 and 2 in such a place where the worker's hand cannot reach the back side of the base metals.

There also is known a mechanical clamping technique called burring caulking in which, as shown in FIG. 22, a shaft 7 (body portion 11*b*) integral with one base metal 1 is caulked to a clamping hole 2*a* of the other base metal 2 to clamp both base metals together mechanically.

Such a mechanical clamping technique is advantageous in that, as compared with the welding technique, the clamping work can be done easily while ensuring safety and even in a narrow space without requiring a large-sized equipment. Further, it is advantageous in that the base metals 1 and 2 can be clamped together rapidly in comparison with the bonding technique.

However, the clamping member used in such mechanical clampings as pin clamping, rivet clamping and burring caulking is clamped to base metals by a plastic deformation of its body portion, so when the clamping member is not properly clamped to base metals and so must be removed from the base metals or when base metals are to be recycled and therefore must be removed from the clamping member, it is necessary to disassemble the clamping member. However, this disassembling work requires much time and labor and there is a fear that the base metals may be damaged in the disassembling work. More particularly, as a disassembling method for this type of a clamping member there is known such a method as shown in FIG. 23. An example thereof will be described below with respect to disassembly of the blind rivet 10 as a clamping member.

First, with a drill 14, the head portion 11*c* of the blind rivet 10 is cut and removed from the body portion 11*b*. Then, by tapping the cut portion in a direction in which the body portion 11*b* comes out of the clamping holes 1*a* and 2*a*, the blind rivet 10 is pulled out from the base metals 1 and 2.

Such a conventional blind rivet disassembling method requires much time and labor for preparatory works, including selection of the drill 14 and the cutting work. Moreover, in cutting the head portion 11*c*, if the tip of the drill 14 reaches the base metal 1 and cuts the clamping hole 1*a* of the base metal 1, with consequent increase in size of the clamping hole 1*a*, as shown in FIG. 24, it will be impossible to ensure a sufficient clamping force even if this base metal 1 is recycled and re-clamped using the blind rivet 10, Generally, once the base metals 1 and 2 are flawed in the blind rivet disassembling work, it becomes difficult to recycle such base metals.

Further, in the case of using this type of a drill in the clamp member disassembling work, the clamping member undergoes a follow-up rotation with rotation of the drill 14 at the time of cutting the head portion 11*c* of the clamping member, thus giving rise to the problem that the base metal 1 is scratched or it is impossible to cut the head portion 11*c*. Particularly, when the base metal 1 is used as an outer component of a product, a scratch, if any, on the surface of the base metal 1 will markedly deteriorate the commercial value of the product. Therefore, such a scratched base metal 1 cannot be recycled, and if it should be recycled, the percent defective of the base metal at the time of disassembly would become very high.

Therefore, to prevent the follow-up rotation of the clamping member with rotation of the drill 14, the head portion 11*c* is cut by the drill 14 while the head portion 11*c* or the body portion 11*b* is gripped by a gripping tool 15 such as pliers or pincers to prevent the follow-up rotation, as shown in FIG. 23, However, this work is performed by two or more workers because it is dangerous if this work is done by one worker, resulting in an increase of personnel expenses in the disassembling work.

Particularly, when the head portion 11*c* of the clamping member is in a flat shape and is difficult to be gripped by the gripping tool 15 and when the base metals 1 and 2 are clamped by the clamping member in such a place where the worker's hand cannot reach the back side of the base metals, it is difficult to prevent the follow-up rotation because the body portion 11*b* cannot be gripped by the gripping tool 15.

In the case of such screw clamping as shown in FIGS. 18(*a*) and 18(*b*), bolt 3, nut 4 and tapping screw 5 as clamping members can in many cases be removed easily from the base metals 1 and 2, but even in the use of a screw, if the threaded portions of the bolt 3 and the nut 4 are fastened with rust or if the threaded portions of the tapping screw 5 and the clamping holes 1*a*, 2*a* are in a mutually adhered state, there occurs an inconvenience such that the screw threads are damaged and the clamping member comprising the bolt 3 and the nut 4 idles relative to the base metals 1 and 2. Moreover, if a polygonal head portion of the bolt 3, an angular portion of the nut 4, or the head portion of the tapping screw 5 is damaged, it becomes very difficult to remove such damaged component.

SUMMARY OF THE INVENTION

It is an object of the present invention to provide a clamping member disassembling device and method capable of removing a clamping member as clamped to base metals from the base metals easily and rapidly without damage to the base metals, as well as an attachment structure thereof and a production system using the disassembling method.

For achieving the above-mentioned object, in the first aspect of the present invention, there is provided a clamping member disassembling device for disassembling a clamping member from base metals, the clamping member comprising a head portion and a body portion and being clamped to the base metals, with the body portion being inserted into clamping holes formed in the base metals and the head portion being in contact with a peripheral edge portion of the clamping hole in one of the base metals, the clamping member disassembling device comprising a cutting means for cutting the body portion of the clamping member in a direction nearly perpendicular to an axial direction of the body portion, a moving means for advancing and retreating the cutting means in the axial direction of the body portion, and a motion changing means for actuating the cutting means in a direction nearly perpendicular to the axial direction of the body portion with an advancing or retreating motion of the cutting means.

According to this construction, the clamping member clamped to the base metals can be removed from the base metals easily and rapidly without damage to the base metals.

In the second aspect of the present invention there is provided, in combination with the first aspect, a clamping member disassembling device further including a keeping means for keeping the cutting means at a certain position in the axial direction of the body portion of the clamping member when the body portion is cut by the cutting means.

In the third aspect of the present invention there is provided, in combination with the first aspect, a clamping member disassembling device further including a pulling means which pulls the head portion of the clamping member through the cutting means away from the body portion in the axial direction of the body portion while the body portion is gripped by the cutting means in a cutting work.

According to this constructions, the head portion can be cut off while it is torn off.

In the fourth aspect of the present invention there is provided a clamping member disassembling device for disassembling a clamping member from base metals, the clamping member comprising a head portion and a body portion and being clamped to the base metals, with the body portion being inserted into clamping holes formed in the base metals and the head portion being in contact with a peripheral edge portion of the clamping hole in one of the base metals, the clamping member disassembling device comprising a cutting means for cutting the clamping member and an actuator for actuating the cutting means, the cutting means comprising blades for cutting a boundary region perpendicular to an axial direction of the body portion and positioned between the body portion and the head portion, in opposite directions with respect to the axis of the body portion, a grip portion substantially integral with the blades and adapted to cause the blades to substantially advance and retreat in interlock with advancing and retreating motions of the actuator while being gripped by the actuator, and a motion changing means for changing the motion of the blades into an opening or closing motion in directions nearly perpendicular to the axial direction of the body portion of the clamping member with an advancing or retreating motion of the blades, and the actuator causing the cutting means to advance and retreat while gripping the grip portion to separate the head portion and the body portion from the boundary region.

According to this construction, the head portion and the body portion can be cut from each other automatically with use of a drive source without using a manual cutting force.

In the fifth aspect of the present invention there is provided, in combination with the fourth aspect, a clamping member disassembling device further including a contact/holding means, the contact/holding means having a contact portion for contact with the head portion or the base metals and also having a fixed portion fixed substantially to a body of the disassembling device, the contact/holding means being adapted to hold the body of the disassembling device at a predetermined position relative to the base metals, thereby allowing the blades to cut the boundary region and allowing the head portion to be pulled in a direction where the disassembling device body is present.

In the sixth aspect of the present invention there is provided, in combination with the fourth aspect, a clamping member disassembling device wherein the motion changing means is substantially integral with the grip portion, and the cutting means possesses elasticity and has an outer peripheral surface formed as an inclined surface which is inclined outward in a direction in which the blades are present.

In the seventh aspect of the present invention there is provided, in combination with the fourth aspect, a clamping member disassembling device wherein the motion changing means is substantially integral with the grip portion.

In the eighth aspect of the present invention there is provided, in combination with the seventh aspect, a clamping member disassembling device wherein the cutting means possesses elasticity and has an outer peripheral surface formed as an inclined surface which is inclined outward in a direction in which the blades are present.

In the ninth aspect of the present invention there is provided an attachment structure having an attachment unit to be attached to a blind rivet clamping device to disassemble a blind rivet, in which clamping device a body portion of the blind rivet integral with a head portion of the blind rivet is inserted into clamping holes formed in base metals and a mandrel of the blind rivet is gripped and pulled to clamp the blind rivet, the attachment unit comprising a cutting means for cutting a boundary region between the body portion and the head portion of the blind rivet from both sides toward an axial direction of the body portion, the boundary region being substantially perpendicular to the axial direction of the body portion, a grip means to be gripped by an actuator of the blind rivet disassembling device so as to cause the cutting means to advance and retreat in the axial direction of the body portion, and a motion changing means which actuates the cutting means in a direction nearly perpendicular to the axial direction of the body portion with an advancing or retreating motion of the grip means.

In the tenth aspect of the present invention there is provided, in combination with the ninth aspect, an attachment structure further including a keeping means for keeping the cutting means at a certain position in the axial direction of the body portion when the body portion is cut by the cutting means.

In the eleventh aspect of the present invention there is provided, in combination with the ninth aspect, an attachment structure further including a pulling means which pulls the head portion through the cutting means away from the body portion in the axial direction of the body portion while the body portion is gripped by the cutting means in a cutting work.

In the twelfth aspect of the present invention there is provided an attachment structure having an attachment unit to be attached to a blind rivet clamping device to disassemble a blind rivet, in which clamping device a body portion of the blind rivet integral with a head portion of the blind rivet is inserted into clamping holes formed in base metals and a mandrel of the blind rivet is gripped and pulled to clamp the blind rivet, the blind rivet clamping device having an actuator for actuating the attachment unit, the attachment unit having a cutting means for cutting the blind rivet, the cutting means comprising blades for cutting a boundary region perpendicular to an axial direction of the body portion and positioned between the body portion and the head portion, in opposite directions with respect to the axis of the body portion, a grip portion substantially integral with the blades and adapted to cause the blades to substantially advance and retreat in interlock with advancing and retreating motions of the actuator while being gripped by the actuator, and a motion changing means for changing the motion of the blades into an opening or closing motion in a direction nearly perpendicular to the axial direction of the body portion of the clamping member with an advancing or retreating motion of the blades, and the actuator causing the cutting means to advance and retreat while gripping the grip portion to separate the head portion and the body portion from the boundary region.

According to the constructions in the above ninth to twelfth aspects, the boundary region between the head portion and the body portion can be cut by utilizing an existing blind clamping device.

In the thirteenth aspect of the present invention there is provided, in combination with the twelfth aspect, an attachment structure wherein the attachment unit is further provided with a contact/holding means having a first contact portion and a second contact portion, the first contact portion being adapted to contact one of the base metals to fix the cutting means, the second contact portion being brought into engagement with a front end of the blind rivet clamping device, allowing the cutting means to be substantially fixed to the blind rivet clamping device, and the cutting means pulls the head portion of the blind rivet toward the blind rivet clamping device while cutting the boundary region.

In the fourteenth aspect of the present invention there is provided, in combination with the twelfth aspect, an attachment structure wherein the motion changing means is substantially integral with the grip portion, and the cutting means possesses elasticity and has an outer peripheral surface formed as an inclined surface which is inclined outward in a direction in which the blades are present.

In the fifteenth aspect of the present invention there is provided, in combination with the twelfth aspect, an attachment structure wherein the motion changing means is substantially integral with the grip portion.

In the sixteenth aspect of the present invention there is provided, in combination with the fifteenth aspect, an attachment structure wherein the cutting means possesses elasticity and has an outer peripheral surface formed as an inclined surface which is inclined outward in a direction in which the blades are present.

According to the constructions in the above thirteenth to sixteenth aspects, the head portion can be torn off from the body portion by utilizing an existing blind rivet clamping device.

In the seventeenth aspect of the present invention there is provided a clamping member disassembling method for disassembling a clamping member from base metals, the clamping member comprising a head portion and a body portion and being clamped to the base metals, with the body portion being inserted into clamping holes formed in the base metals and the head portion being in contact with a peripheral edge portion of the clamping hole in one of the base metals, which method comprises causing at least a pair of edges of blades to face between the head portion of the clamping member and the base metals, the blades capable of being opened and closed with respect to each other and the edges thereof being adapted to engage each other, causing in this state an actuator of a cutting force output unit to advance or retreat, the cutting force output unit outputting a cutting force for cutting off the head portion and the body portion from each other, changing the advancing or retreating motion of the actuator into an opening or closing motion for opening or closing the blades along a boundary between the head portion of the clamping member and the base metals, through a motion direction changing means, and allowing the edges of the blades to be engaged with each other by the closing motion of the blades to cut off the body portion.

According to this construction there is obtained the same effect as in the fourth aspect.

In the eighteenth aspect of the present invention there is provided a clamping member disassembling method wherein a clamping member which clamps at least two base metals is removed to unclamp the base metals, the clamping member comprising at least a body portion to be inserted into clamping holes of the base metals and a head portion having an outside diameter larger than an inside diameter of each of the clamping holes, the head portion being brought into pressure contact with a peripheral edge portion of the clamping hole in one of the base metals, the method comprising causing a breaking member to get into a boundary region as a contact portion between the base metals and the head portion, and causing the breaking member to move away from the head portion in a state in which the breaking member has entered the boundary region, thereby breaking the head portion from the body portion.

According to this construction it is possible to tear off the head portion from the body portion.

In the nineteenth aspect of the present invention there is provided a production system wherein a clamping member comprising a head portion and a body portion and clamped to base metals, with the body portion being inserted into clamping holes formed in the base metals and the head portion being in contact with a peripheral edge portion of the clamping hole in one of the base metals, is removed and the base metals are recovered, the production system including a clamping member disassembling device, the clamping member disassembling device comprising a cutting means for cutting off the body portion in a direction nearly perpendicular to an axial direction of the body portion, a moving means for advancing and retreating the cutting means in the axial direction of the body portion, and a motion changing means which actuates the cutting means in a direction nearly perpendicular to the axial direction of the body portion with an advancing or retreating motion of the cutting means, and in which production system the clamped condition of the clamping member to the base metals is checked and if it is found to be defective, the clamping member is removed from the base metals and the base metals are recovered.

In the twentieth aspect of the present invention there is provided a production system wherein a clamping member comprising a head portion and a body portion and clamped to base metals, with the body portion being inserted into clamping holes formed in the base metals and the head portion being in contact with a peripheral edge portion of the clamping hole in one of the base metals, is removed and the base metals are recovered, the production system including a clamping member disassembling device, the clamping member disassembling device comprising a cutting means for cutting off the body portion in a direction nearly perpendicular to an axial direction of the body portion, a moving means for advancing and retreating the cutting means in the axial direction of the body portion, and a motion changing means which actuates the cutting means in a direction nearly perpendicular to the axial direction of the body portion with an advancing or retreating motion of the cutting means, wherein the clamping member is removed from the base metals and the base metals are recovered.

According to the constructions in the above nineteenth and twentieth aspects it is easy to recover the base metals from which the clamping member has been disassembled and removed.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENTS

Embodiments of the present invention will be described hereinunder with reference to the accompanying drawings.

Figure 1:
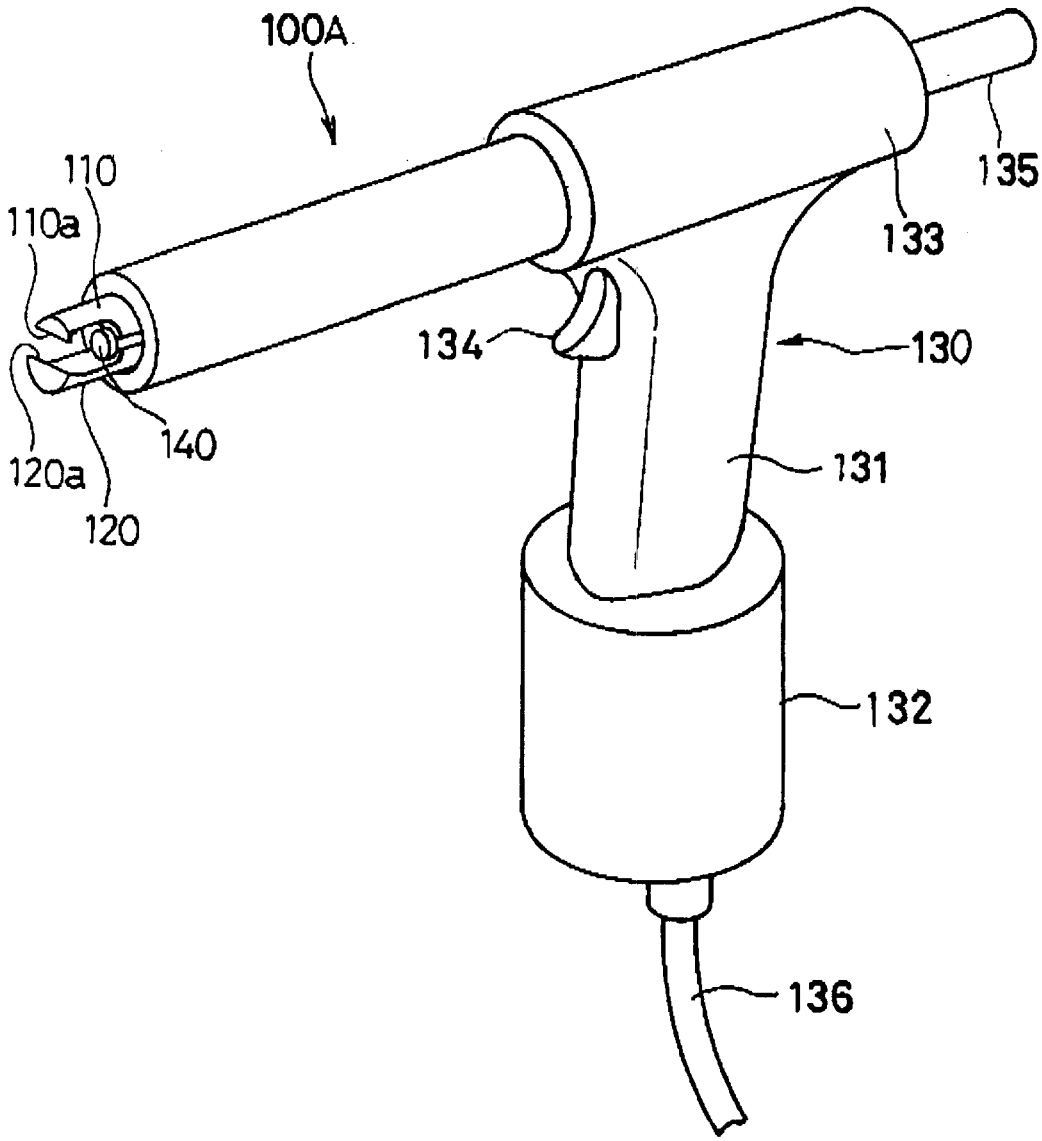
FIG. 1 is a perspective view showing an appearance of a disassembling device according to the first embodiment of the present invention.

FIG. 1 is an appearance diagram showing an entire construction of a clamping member disassembling device 100A embodying the present invention.

Figure 2:
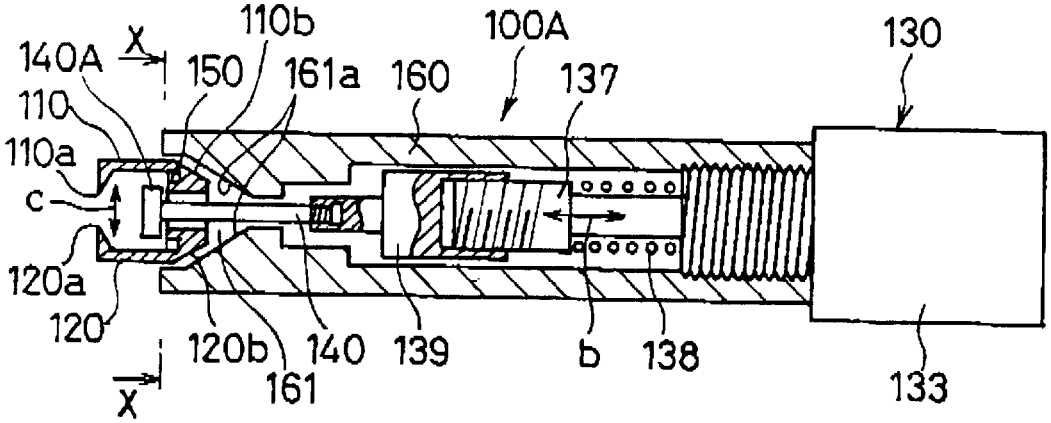
FIG. 2 is a sectional view of a principal portion of the disassembling device shown in FIG. 1.

The disassembling device 100A has a pair of blades 110 and 120 and a cutting force output unit 130. As shown in FIG. 2, the blades 110 and 120 are provided at respective front ends with edges 110*a* and 120*a* adapted to engage each other. On a base end side of the blades 110 and 120 is located one end of a blades driving shaft (moving means) 140, which has an engaging portion 140A at the opposite end thereof.

Figure 3:
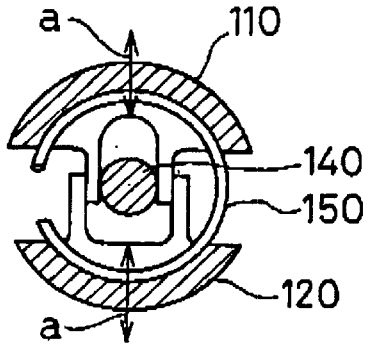
FIG. 3 is a sectional view taken on line X—X of the disassembling device shown in FIG. 2.

As shown in FIG. 3, the blades 110 and 120 are constituted so that they can be opened and closed in the directions of arrows "a." The edges 110*a* and 120*a* are normally urged away from each other and kept open with a biasing force of a ring-like snap ring 150 fitted in the blades 110 and 120.

The cutting force output unit 130 is formed, for example, in the shape of a pistol having a handle portion 131, as shown in FIG. 1. The handle portion 131 is provided with an air valve 132, an air cylinder 133 as a disassembling device body, a trigger 134 and an adjusting knob 135.

Compressed air is fed from an air pump (not shown) to the air valve 132 through an air hose 136. In FIG. 1, when the trigger 134 is pulled, the air valve 132 is opened and air is fed to the air cylinder 133. The pressure of the air thus fed can be adjusted with the adjusting knob 135.

A cylindrical blades holding member 160 is attached to the air cylinder 133, as shown in FIG. 2. The air cylinder 133 has an actuator 137 which can advance and retreat in the directions of arrows "b." A coiled spring 138 is interposed between the actuator 137 and the air cylinder 133 to urge the actuator 137 in a direction in 15 which the blades 110 and 120 project from the blades holding member 160. The air cylinder 133 when supplied with air actuates the actuator 137 in the direction opposite to the projecting direction against the biasing force of the coiled spring 138. The blades driving shaft 140 is connected at an end portion thereof to a front end of the actuator 137 through a joint member 139.

The disassembling device 100A has a motion changing means (also referred to herein as actuation means) which changes advancing and retreating motions of the actuator 137 into opening and closing motions of the edges 110*a* and 120*a* of the blades 110 and 120. In this embodiment, the motion changing means is constituted by a blades holding portion 161 provided at a front end of the blades holding member 160. The blades holding portion 161 holds the blades 110 and 120 so that the blades can be opened and closed.

The blades holding portion 161 has an inclined surface 161*a*. Outer peripheral surfaces of the base end portions of the blades 110 and 120 are formed as inclined surfaces 110*b* and 120*b*, respectively. As the blades 110 and 120 move in the direction opposite to the projecting direction of the blades driving shaft 140, the inclined surfaces 110*b* and 120*b* come into abutment with the inclined surface 161*a*, so that the blades are displaced in directions in which their edges 110*a* and 120*a* close, while with movement of the blades driving shaft 140 in its projecting direction the inclined surfaces 110*b* and 120*b* move out of abutment with the inclined surface 161*a*, whereby the blades are displaced in directions in which their edges 110*a* and 120*a* open. In this way the blades 110 and 120 are opened and closed.

Now, with reference to FIGS. 4(*a*) to 4(*c*), a description will be given below of a cutting work for cutting the body portion 11*b* of the blind rivet 10 with use of the disassembling device 100A.

Figure 4A:
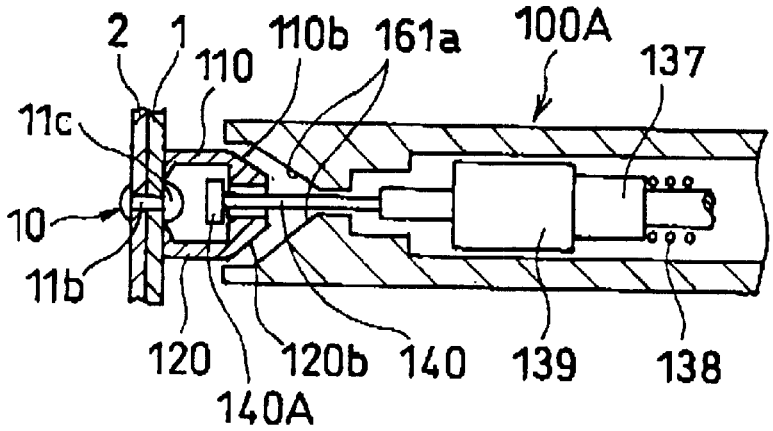
FIG. 4 shows a blind rivet cutting process using the disassembling device illustrated in FIG. 1, in which FIG. 4(*a*) is an explanatory diagram showing a state in which blade edges are put between a head portion of the blind rivet and a base metal, FIG. 4(*b*) is an explanatory diagram showing a state in which the blade edges are caused to bite into a body portion of the blind rivet, and FIG. 4(*c*) is an explanatory diagram showing a state in which the body portion of the blind rivet has been cut off.
Figure 4B:
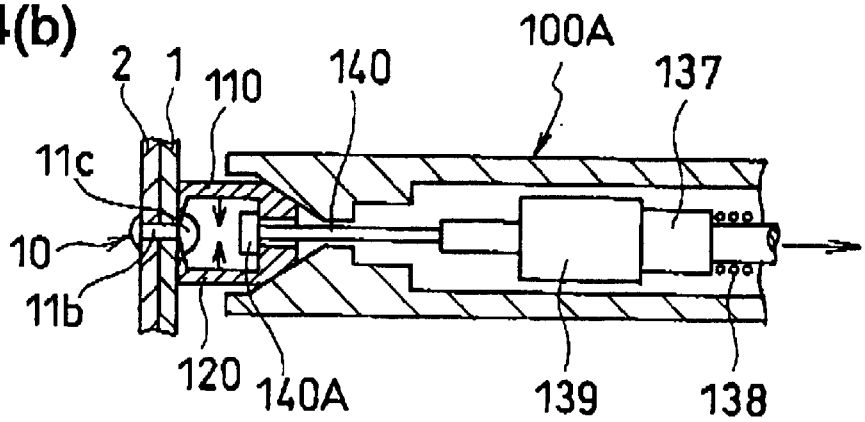
Figure 4C:
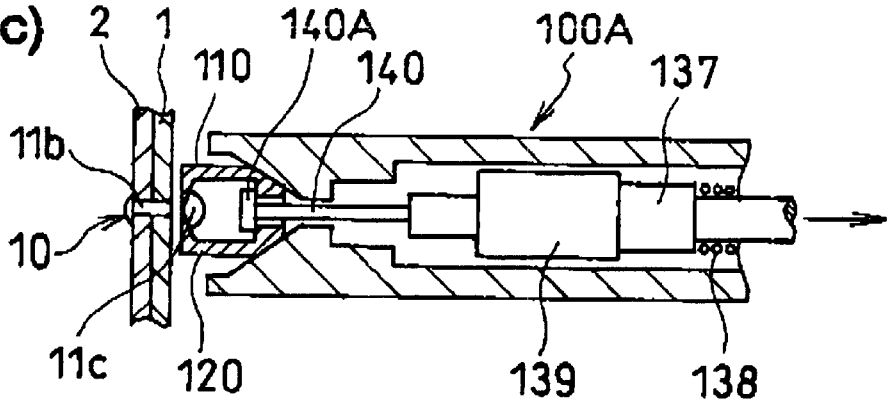

First, as shown in FIG. 4(*a*), the edges 110*a* and 120*a* of the blades 110 and 120 are allowed to face a boundary region between the base metal 1 and the head portion 11*c* of the blind rivet, followed by pulling the trigger 134 of the cutting force output unit 130. As a result, the air valve 132 is opened and a preconditioned air is fed to the air cylinder 133, so that, as shown in FIG. 4(*b*), the actuator 137 is actuated in the direction opposite to the projecting direction against the biasing force of the coiled spring 138, whereby the blades 110 and 120 are pulled in a direction of approaching the blades holding portion 161.

As the blades 110 and 120 are pulled toward the side where the air cylinder 133 is positioned, the blades holding member 160 moves relatively toward the side where the base metals 1 and 2 are positioned, so that the inclined surfaces 110*b* and 120*b* formed at the base end portions of the blades 110 and 120 and the inclined surface 161*a* of the blades holding portion 161 come into abutment with each other, whereby the blades 110 and 120 are displaced in mutually approaching directions perpendicular to the axial direction of the blind rivet body portion, as shown in FIG. 4(*b*).

In this way a cutting force based on advance or retreat of the actuator 137 is converted to a force for opening or closing the edges 110*a* and 120*a* through the motion direction changing means and along the boundary region between the body portion 11*b* and the head portion 11*c* of the blind rivet 10.

With the cutting force thus transmitted to the blades 110 and 120 from the actuator 137, the edges 110*a* and 120*a* approach toward each other, then bite in between the head portion 11*c* of the blind rivet 10 and the base metal 1 and nip the blind rivet body portion 11*b* to cut off the body portion 11*b* and the head portion 11*c* from each other. Although air is used as a drive source for the cutting force output unit 130, an oil pressure may be used as the drive source.

According to the disassembling device 100A, since the edges 110*a* and 120*a* are moved rectilinearly along a boundary plane Z1 (see FIG. 20(*f*)) between the head portion 11*c* and the base metal 1 to cut off the body portion 11*b* and the head portion 11*c* from each other, the body portion and the head portion can be cut easily by a single cutting operation while avoiding the inconvenience involved in the conventional disassembling method using a drill such that at the time of disassembling the blind rivet 10 the rivet turns idle or the surface of the base metal 1 is damaged by such idle rotation of the blind rivet 10.

According to the disassembling device 100A, it is not necessary that the head portion 11*c* and the body portion 11*b* be gripped with a gripping tool such as pliers or pincers at the time of cutting the blind rivet 10, the body portion 11*b* and the head portion 11*c* can be cut off easily even when both are of shapes difficult to be gripped or are located in a position where they are difficult to be gripped.

[Example of Disassembling Device 100B using Blind Rivet Clamping Device 13]

Figure 5:
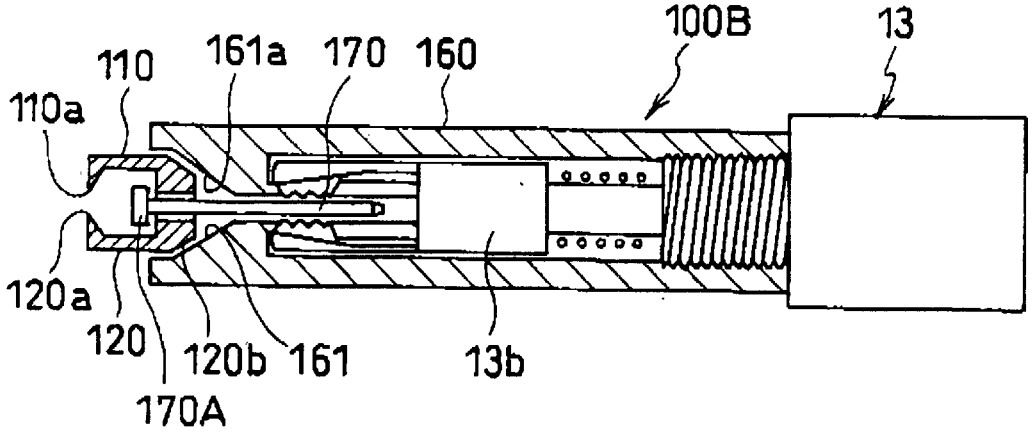
FIG. 5 is a sectional view of a principal portion of a disassembling device according to the second embodiment of the present invention.

As the cutting force output unit 130 there may be used such a blind rivet clamping device 13 as shown in FIGS. 21(*b*) and 21(*c*) FIG. 5 shows a disassembling device 100B using the said blind rivet clamping device 13. In the disassembling device 100B shown in FIG. 5, a jaw 13*b* corresponds to the actuator 137 in the cutting force output unit 130 shown in FIG. 2. The disassembling device 100B has a grip shaft (grip portion) 170 which exhibits the same function as that of the blades driving shaft 140. The grip shaft 170 has an engaging portion 170A for engagement with base end portions of blades 110 and 120. The grip shaft 170 can be attached to and detached from the blades 110 and 120.

Figure 6A:
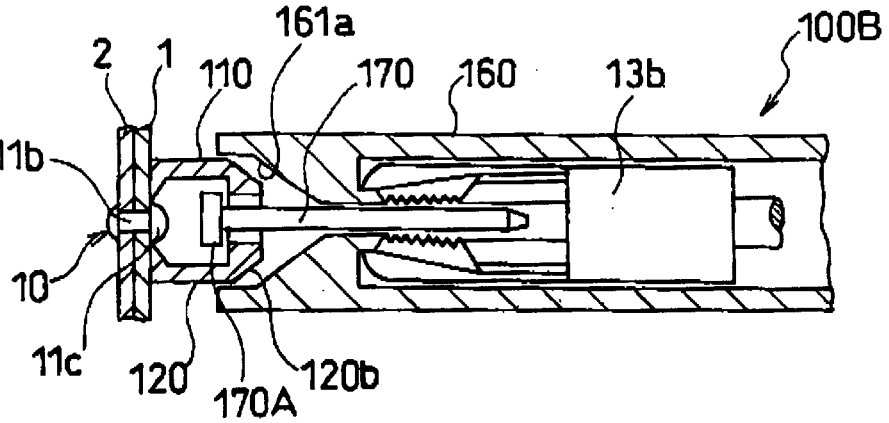
FIG. 6 shows a cutting process using the disassembling device illustrated in FIG. 5, in which FIG. 6(*a*) is an explanatory diagram showing a state in which blade edges are put between a head portion of a blind rivet and a base metal, FIG. 6(*b*) is an explanatory diagram showing a state in which the blades edges are caused to bite into a body portion of the blind rivet, and FIG. 6(*c*) is an explanatory diagram showing a state in which the body portion of the blind rivet has been cut off.
Figure 6B:
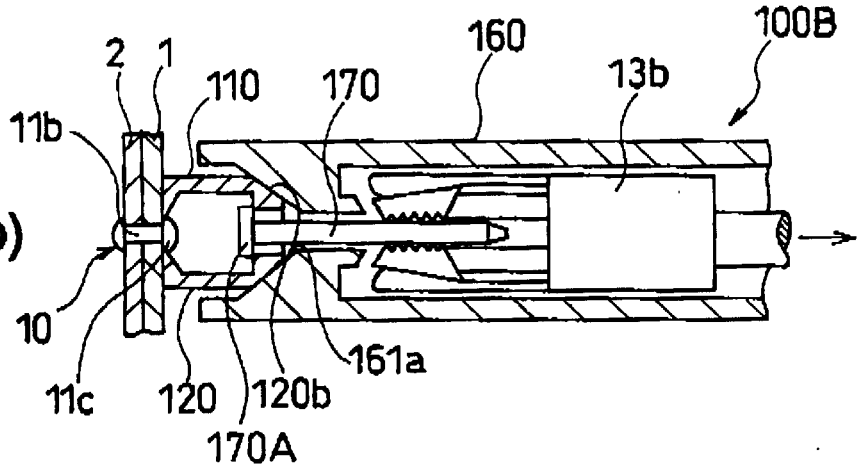
Figure 6C:
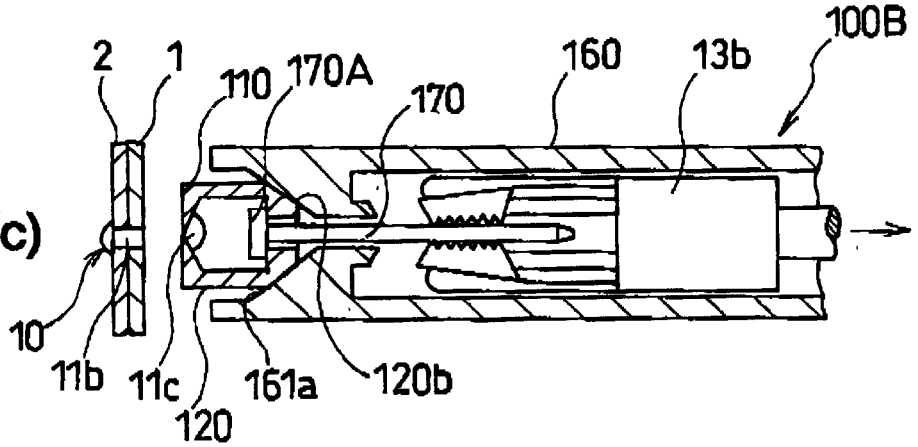

FIGS. 6(*a*) to 6(*c*) show a cutting process of cutting the body portion 11*b* and the head portion 11*c* of the blind rivet 10 clamped to base metals 1 and 2, by means of the disassembling device 100B using the blind rivet clamping device 13.

First, as shown in FIG. 6(*a*), the edges 110*a* and 120*a* of the blades 110 and 120 are allowed to face a boundary plane between the head portion 11*c* and the base metal 1. In this state, the trigger (not shown) of the blind rivet clamping device 13 is pulled. As a result, the jaw 13*b* grips the grip shaft 170, which is pulled into the interior of the blind rivet clamping device 13. That is, the grip shaft 170 is pulled away from the body portion 11*b* along the axial direction of the body portion and the blades 110 and 120 are moved in the same direction as the moving direction of the grip shaft 170.

With this movement of the blades 110 and 120 toward the blind rivet clamping device 13, the blades holding member 160 is displaced relatively toward the blades 110 and 120 and the inclined surface 161*a* of the blades holding portion 161 comes into abutment with the inclined surfaces 110*b* and 120*b* formed at the base portions of the blades 110 and 120.

As a result, the edges 110*a* and 120*a* of the blades 110 and 120 are displaced toward each other, as shown in FIG. 6(*b*), so that the edges 110*a* and 120*a* bite in between the head portion 11*c* of the blind rivet 10 and the base metal 1, whereby the head portion 11*c* and the body portion 11*b* of the blind rivet are cut off from each other.

According to this disassembling device 100B there are attained the following effects in addition to the effects obtained using the disassembling device 100A.

As the cutting force output unit 130 the blind rivet clamping device 13 can be used as it is, so in the case of clamping the blind rivet 10 to the base metals 1 and 2 with use of the blind rivet clamping device 13, if the clamped condition is defective and hence there arises the necessity of separating the blind rivet 10 from the base metals 1 and 2, the grip shaft 170 and the paired blades 110 and 120 can be attached as attachment members to the blind rivet clamping device 13 and the blind rivet cutting work can be done using the blind rivet clamping device 13 as the disassembling device 100B, so that the cutting work and re-clamping work for the blind rivet 10 can be done extremely rapidly.

According to the blind rivet clamping device 100B, moreover, since the existing blind rivet clamping device 13 can be used as the cutting force output unit, the blind rivet clamping device 100B can be constituted in an extremely inexpensive manner.

Further, according to the construction of the disassembling device 100B, the blades 110 and 120 as attachment members can be attached to and detached from the blades holding member 160 and also detached from the grip shaft 170, so when the blades 110 and 120 are not of a size suitable for the blind rivet 10, it is easy to change the blades into blades 110 and 120 of a suitable size.

Figure 7A:
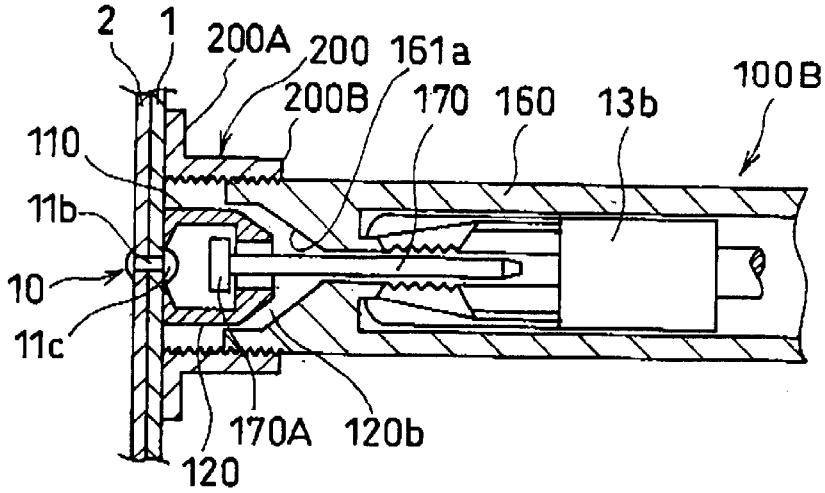
FIG. 7 shows an example of providing a contact/holding means in a body of the disassembling device illustrated in FIG. 5, in which FIG. 7(*a*) is an explanatory diagram showing a state in which the blade edges were applied to the head portion of the blind rivet and FIG. 7(*b*) is an explanatory diagram showing a state in which the head portion were torn off.
Figure 7B:
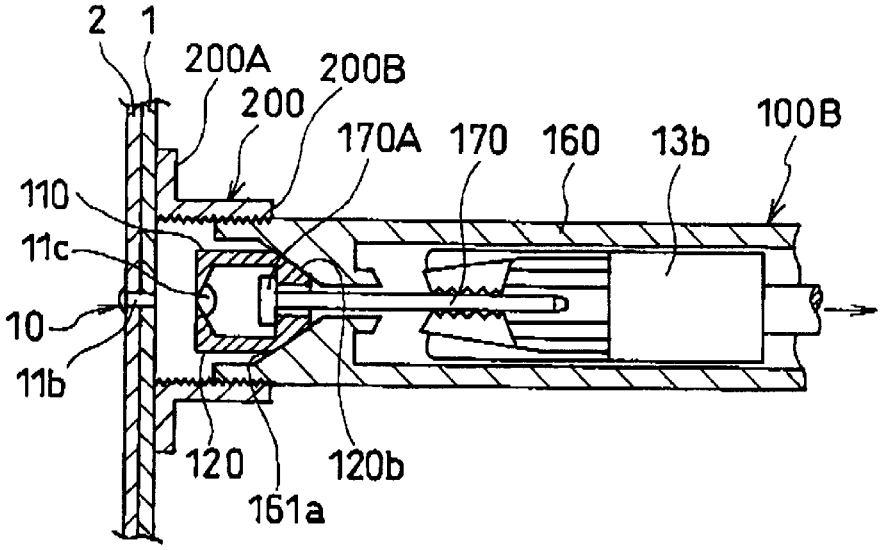

There may be adopted such a construction as shown in FIGS. 7(*a*) and 7(*b*) in which a contact/holding member 200 having a contact portion (first contact portion) 200A for contact with the base metal 1 and also having a fixed portion (second contact portion) 200B to be fixed to an end portion of the blades holding member 160 as the disassembling device body is brought into threaded engagement with the end portion of the blades holding member 160, and the head portion 11*c* is torn off while allowing the grip shaft 170 to function as a pulling means. In this case, the contact/holding member 200 functions as a keeping means for keeping the blades 110 and 120 as cutting means at a predetermined certain position. Although in this construction the contact portion 200A is brought into contact with the base metal 1, a modification may be made so that the head portion 11*c* is contacted with the base metal 1.

[Modified Example 1 of Blades]

Figure 8:
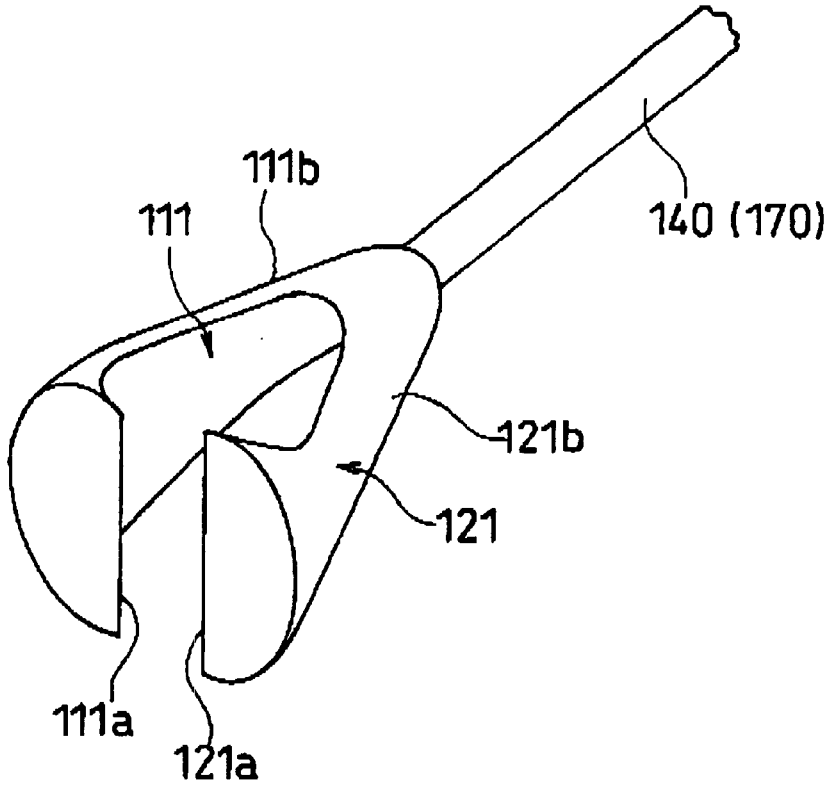
FIG. 8 is a perspective view showing a first modified example of blades according to the present invention.
Figure 9A:
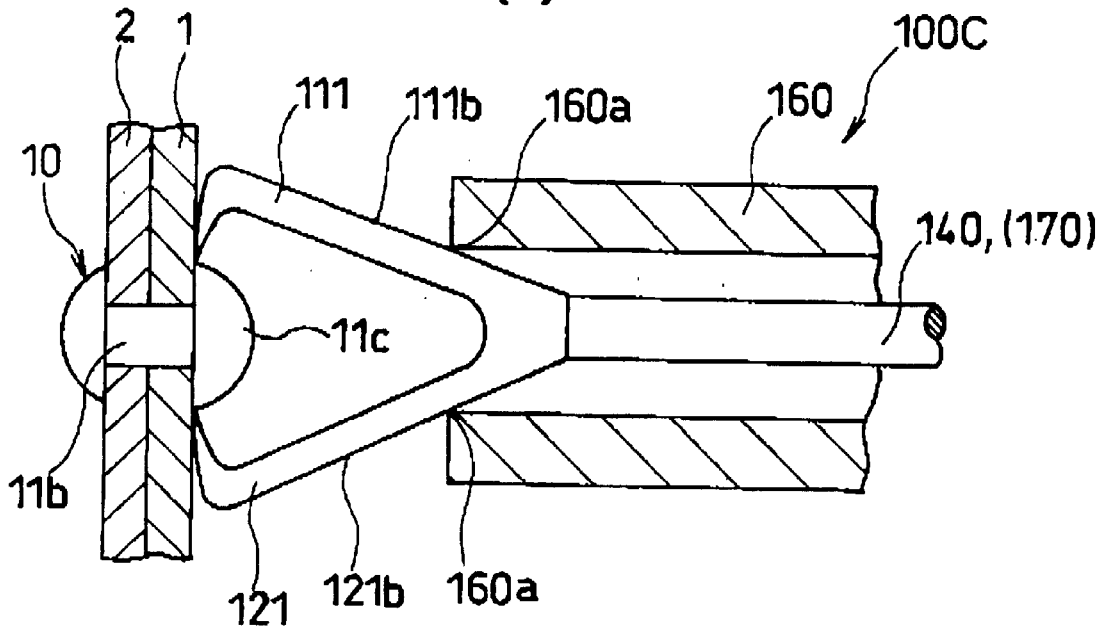
FIG. 9 shows a cutting process using the blades illustrated in FIG. 8, in which FIG. 9(*a*) is an explanatory diagram showing a state in which edges of the blades are put between the head portion of the blind rivet and a base metal and FIG. 9(*b*) is an explanatory diagram showing a state in which the blade edges are caused to bite into the body portion of the blind rivet.
Figure 9B:
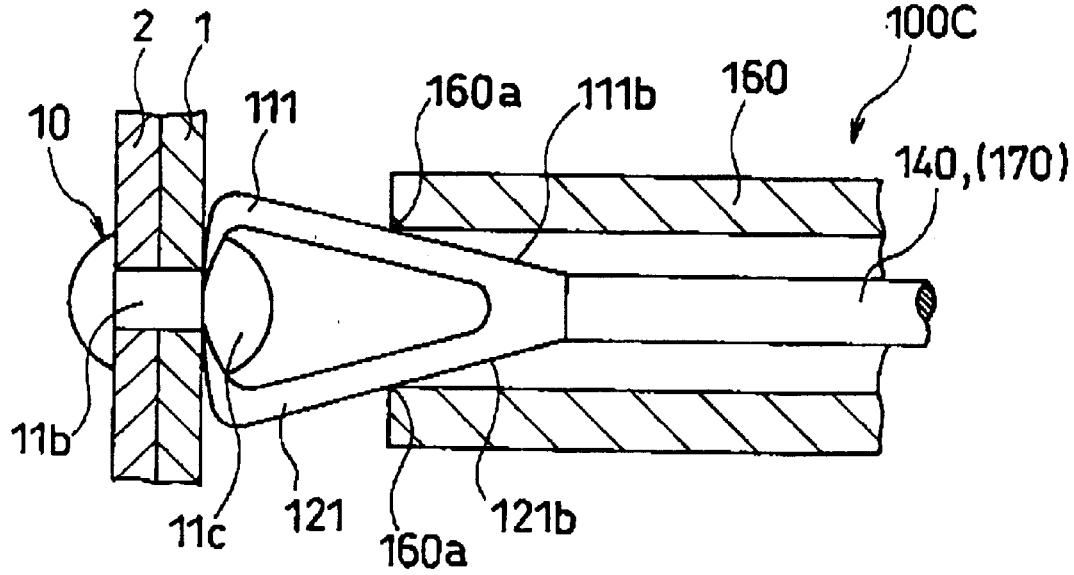

FIGS. 8 and 9(*a*), 9(*b*) illustrate a first modified example of blades 111 and 121 according to the present invention. The blades 111 and 121 are substantially integral with a front end portion of a blades driving shaft 140 or a grip shaft 170. The blades 111 and 121 are formed in a radially divided shape, with inclined surfaces 111*b* and 121*b* being formed on the outer peripheries of the blades 111 and 121, respectively. The inclined surfaces 111*b* and 121*b* are open outwards in a direction in which edges 111*a* and 121*a* of the blades 111 and 121 are present. The blades 111 and 121 are constituted by an elastic member and are attached to a disassembling device 100C shown in FIGS. 9(*a*) and 9(*b*). Their inclined surfaces 111*b* and 121*b* are brought into abutment with an inner peripheral edge portion 160*a* located at a front end of a blades holding member 160 in the disassembling device 100C.

The cutting work with this disassembling device 100C is performed in accordance with the following procedure.

When the blades driving shaft 140 or the grip shaft 170 is driven, the blades holding member 160 and the blades 111 and 121 move relatively with respect to each other, so that their inclined surfaces 111*b* and 121*b* come into abutment with the inner peripheral edge portion 160*a,* as shown in FIG. 9(*a*), and the blades 111 and 121 are displaced against their own resilience in a direction in which their radial angle (opening angle) becomes smaller.

As a result, as shown in FIG. 9(*b*), the edges 111*a* and 121*a* of the blades 111 and 121 approach each other in mutually engaging directions and bite in between the body portion 11*b* and the head portion 11*c* of the blind rivet 18 to cut off the body portion and the head portion from each other. Thereafter, when the blades driving shaft 140 or the grip shaft 170 is driven in the opposite direction, the blades 111 and 121 revert to their original state by virtue of their own elastic restoring force.

Thus, according to this disassembling device 100C, the construction of blade opening/closing means is simplified.

Figure 10A:
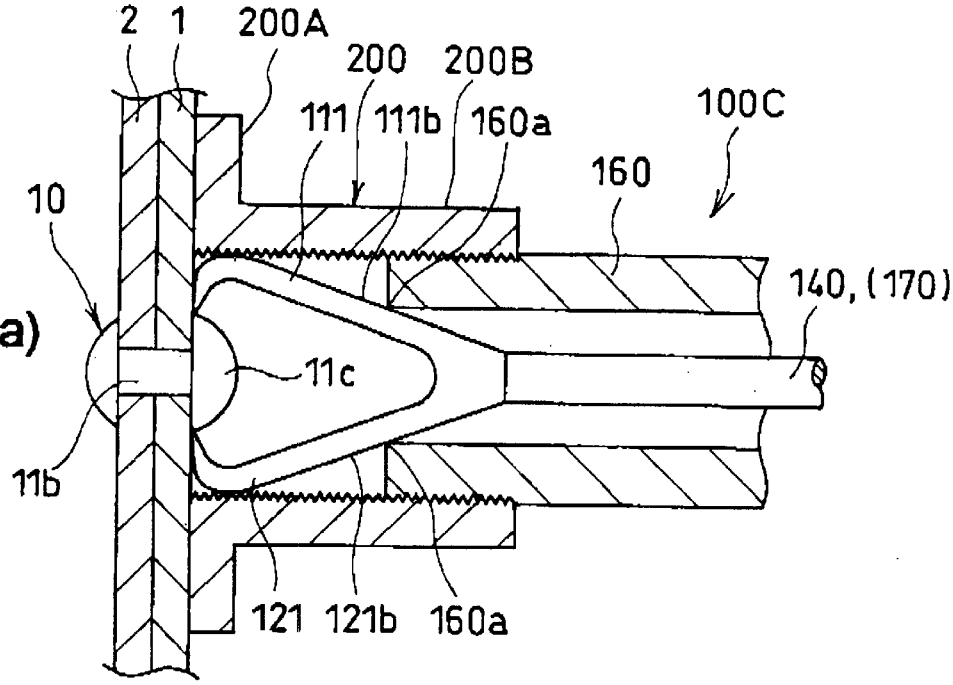
FIG. 10 shows an example of providing a contact/holding means for the blades illustrated in FIG. 8, in which FIG. 10(*a*) is an explanatory diagram showing a state in which the blade edges were applied to the head portion of the blind rivet and FIG. 10(*b*) shows a state in which the blade edges are caused to bite into the head portion of the blind rivet.
Figure 10B:
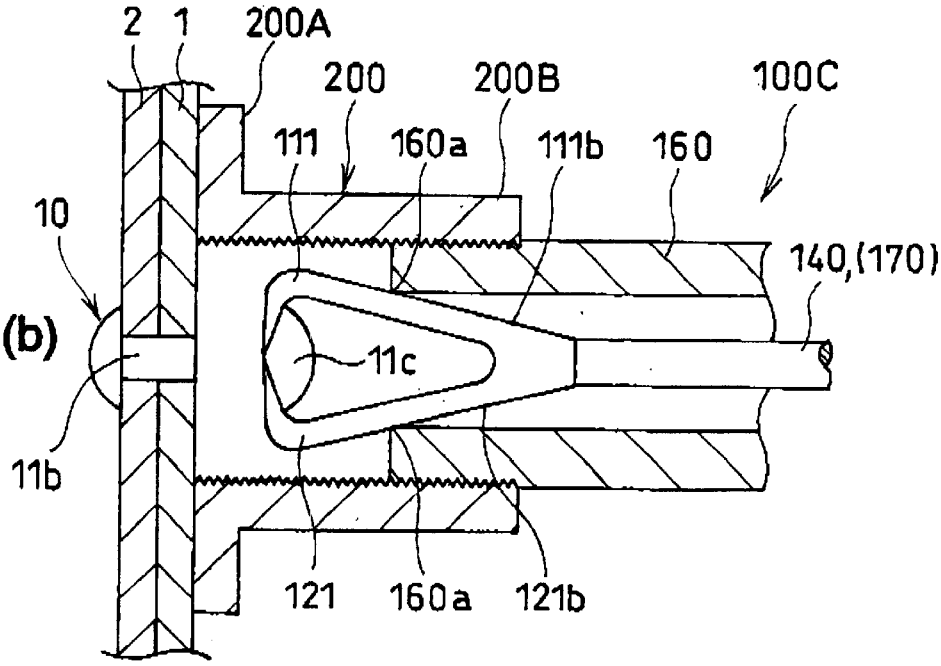

There may be adopted such a construction as shown in FIGS. 10(*a*) and 10(*b*) in which a contact/holding member 200 having a contact portion 200A for contact with the base metal 1 and also having a fixed portion 200B to be fixed to an end portion of the blades holding member 160 is brought into threaded engagement with an end portion of the blades holding member 160 and the head portion 11*c* is torn off by the blades 111 and 121 as breaking members while allowing the blades driving shaft 140 or the grip shaft 170 to function as a pulling means.

[Modified Example 2 of Blades]

Figure 11A:
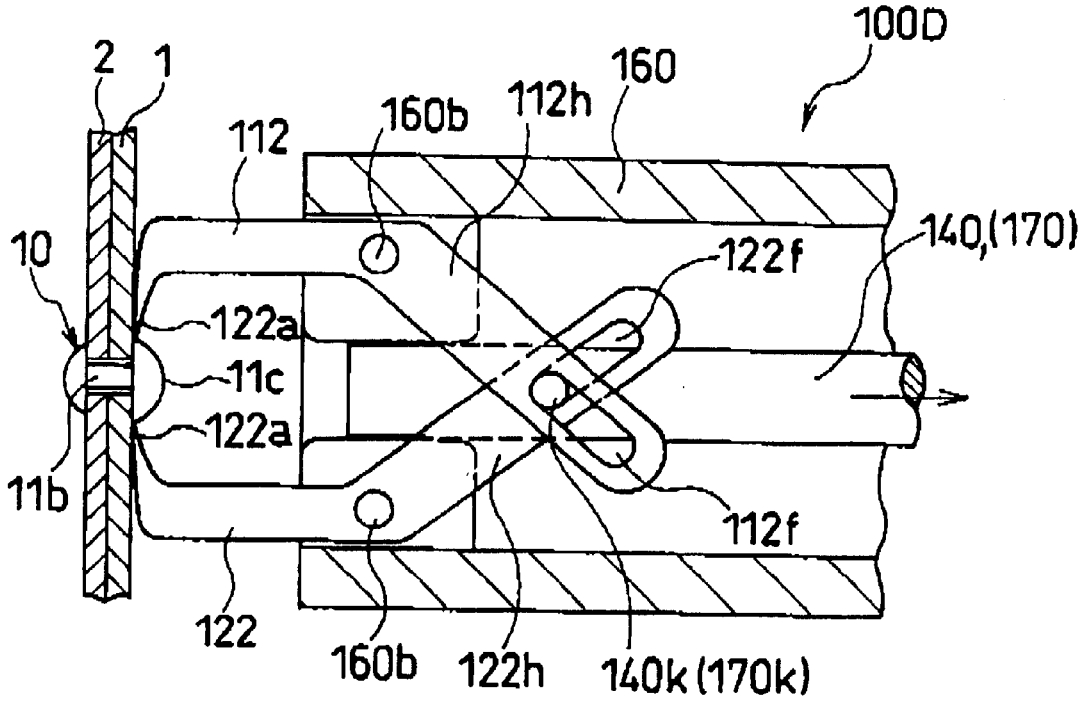
FIG. 11 is a sectional view of a principal portion of a disassembling device for explaining a second modified example of blades according to the present invention, in which FIG. 11(*a*) is a sectional view of a principal portion, showing a state in which edges of the blades are put between the head portion of the blind rivet and a base metal and FIG. 11(*b*) is a sectional view of a principal portion, showing a state in which the blade edges are caused to bite into the body portion of the blind rivet.
Figure 11B:
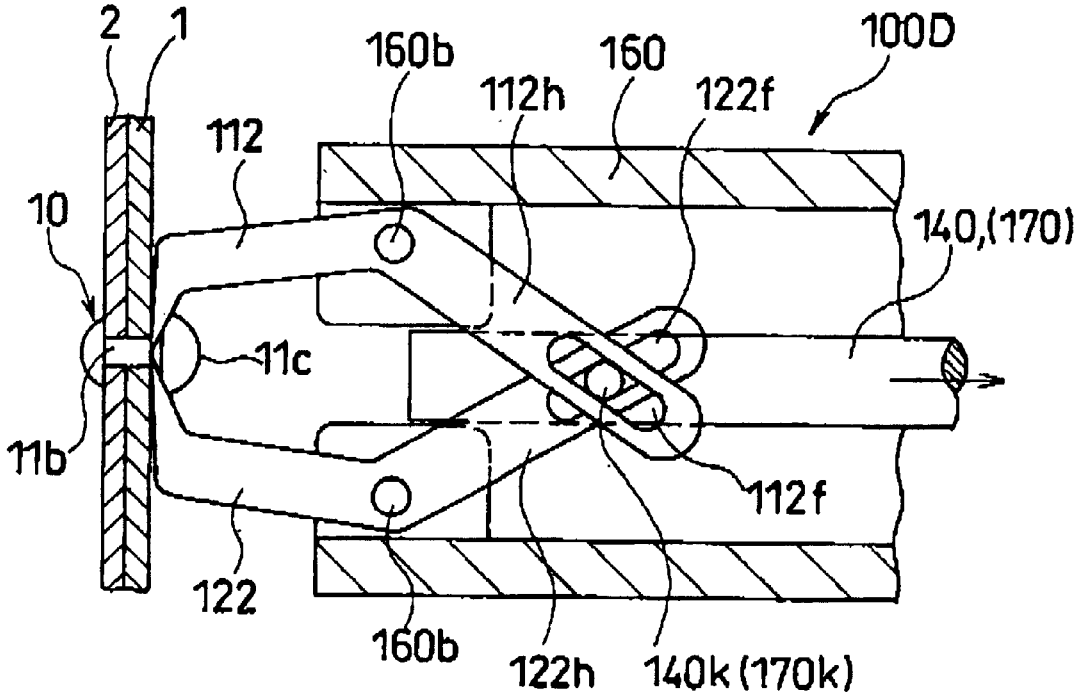

FIG. 11 illustrates a second modified example of blades according to the present invention.

Blades 112 and 122 of this modified example have respective cross link portions 112*h* and 122*h*. A blades holding member 160 is provided with pivot shafts 160*b* so that the blades 112 and 122 are pivotable with the pivot shafts 160*b* as fulcrums. Guide holes 112*f* and 122*f* are formed respectively in the cross link portions 112*h* and 122*h*.

The blades 112 and 122 are attached to a disassembling device 100D. An engaging pin 140*k* (170*k*) is projected from a blades driving shaft 140 or a grip shaft 170 in the disassembling device 100D and is fitted in the guide holes 112*f* and 122*f*. The blades 112 and 122 and the blades driving shaft 140 or the grip shaft 170 constitute a slide link mechanism.

The cutting work with this disassembling device 100D is carried out in accordance with the following procedure.

When the blades driving shaft 140 or the grip shaft 170 is pulled toward the inside of the blades holding member 160 while allowing edges 112*a* and 122*a* of the blades 112 and 122 to face a boundary plane between the head portion 11*c* and the base metal 1, the edges 112*a* and 122*a* of the blades 112 and 121 are pivotally moved toward each other with the pivot shafts 160*b* as fulcrums.

As a result, the edges 112*a* and 122*a* bite in between the head portion 11*c* and the base metal 1 to cut off the body portion 11*b* and the head portion 11*c* from each other.

According to this disassembling device 100D, the blade edges 112*a* and 122*a* can be opened and closed with only advancing and retreating motions of the blades driving shaft 140 or the grip shaft 170, and the blades 112 and 122 can be restored to their original state without the need of using such a snap ring 150 as shown in FIG. 3 or without the need of constituting the blades 111 and 121 shown in FIG. 8 with use of resilient members.

[Structure of Blind Rivet]

Figure 12A:
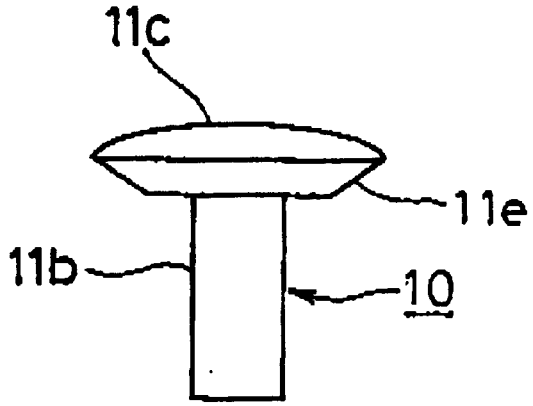
FIG. 12 shows blind rivets which are each formed so as to permit blade edges to bite in easily between a head portion of the blind rivet and a base metal, in which FIG. 12(*a*) is a side view showing a blind rivet whose head portion has an inclined portion, FIG. 12(*b*) is a side view showing a blind rivet whose head portion has a stepped portion, and FIG. 12(*c*) shows a blind rivet whose head portion has a thick-wall portion.
Figure 12B:
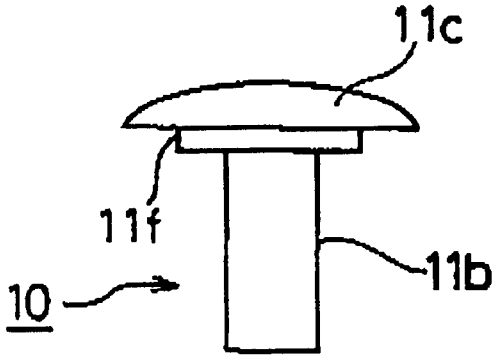
Figure 12C:
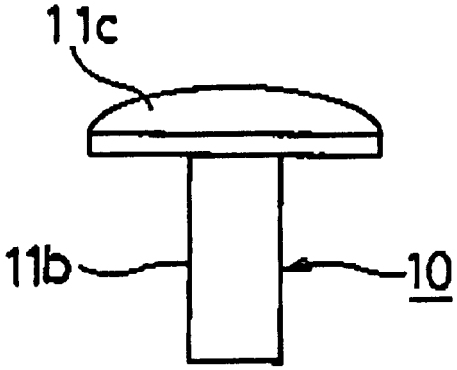

FIGS. 12(*a*) to 15(*c*) illustrate structures of blind rivets 10 for making it easier for the edges 111*a* and 121*a* of the blades 111 and 121 to bite in the boundary plane between the head portion 11*c* of each blind rivet 10 and the base metal 1. In FIG. 12(*a*), an inclined portion 11*e* is formed on the underside of the head portion 11*c* which faces the base metal 1. It is preferable that the blind rivet having the inclined portion 11*e* be an iron-based blind rivet rather than an aluminum-based blind rivet. This is because an iron-based blind rivet is hard and therefore it is difficult for the edges 111*a* and 121*a* of the blades 111 and 121 to bite in the boundary portion unless there is provided the inclined portion 11*e*.

Instead of forming the inclined portion 11*e* on the underside of the head portion 11*c* of the blind rivet 10 there may be formed such a stepped portion 11*f* as shown in FIG. 12(*b*) on the underside of the head portion 11*c*. Further, a thick-wall portion 11*g* may be formed on the underside of the head portion 11*c*, as shown in FIG. 12(*c*).

Figure 13A:
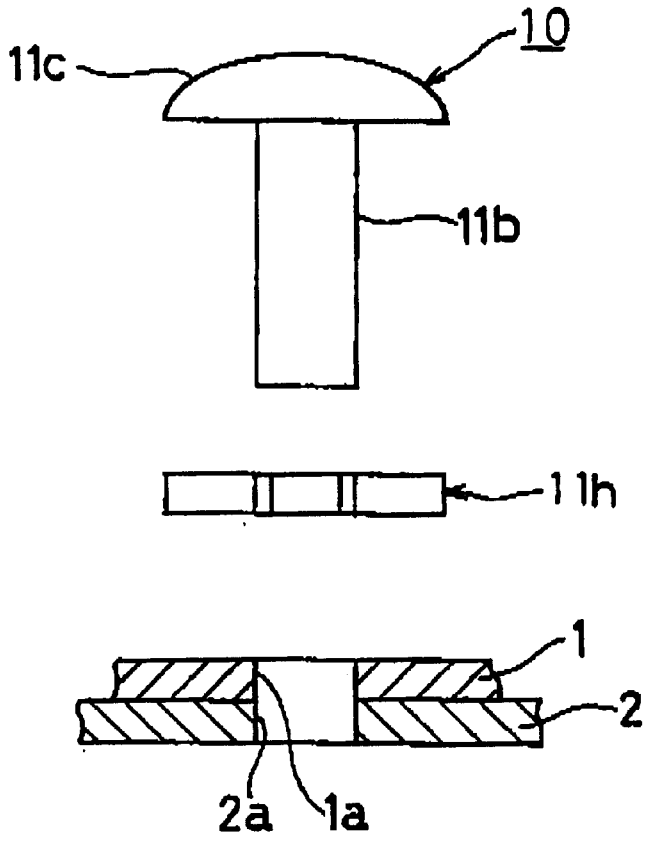
FIG. 13 shows a collar fitted on a blind rivet, in which FIG. 13(*a*) is an explanatory diagram showing a state in which a collar with a slot formed therein is about to be fitted on a body portion of the blind rivet, FIG. 13(*b*) is an explanatory diagram showing a state in which the blind rivet with the collar fitted thereon has been inserted through base metals, and FIG. 13(*c*) is an explanatory diagram showing a state in which the base metals have been clamped by a plastic deformation of the blind rivet body portion.
Figure 13B:
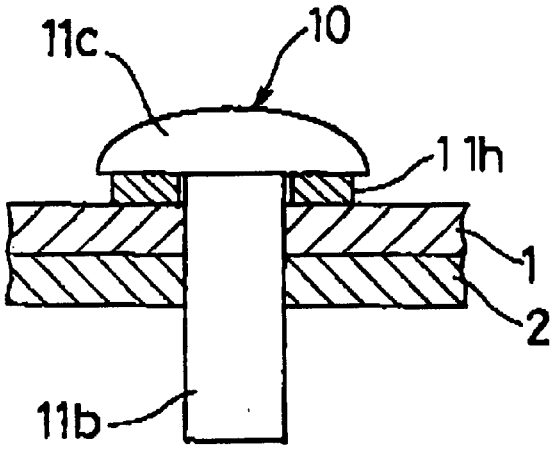
Figure 13C:
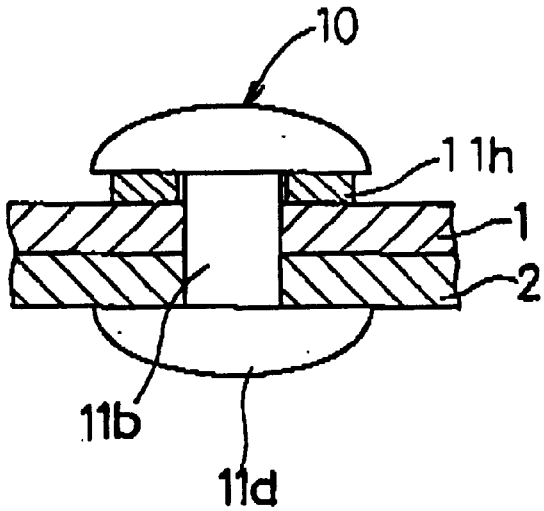

There may be adopted such a construction as shown in FIGS. 13(*a*) to 13(*c*), in which a flat plate-shaped collar 11*h* is fitted on the body portion 11*b* of the blind rivet 10 so as to be interposed between the head portion 11*c* and the base metal 1, thereby making it easier for the blade edges 111*a* and 121*a* to bite in the boundary portion. The collar 11*h* is broken in disassembling the blind rivet 10.

Figure 14A:
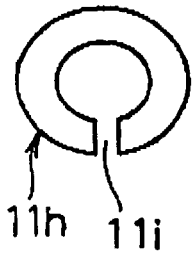
FIG. 14(*a*) is a plan view showing the slotted collar illustrated in FIGS. 13(*a*) to 13(*c*), FIG. 14(*b*) is a plan view showing a collar having V grooves, and FIG. 14(*c*) is a plan view showing a color having through holes.
Figure 14B:
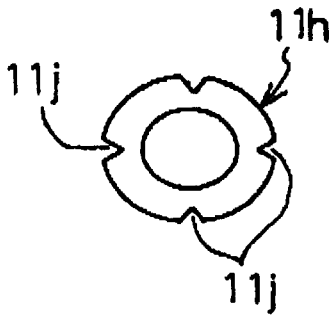
Figure 14C:
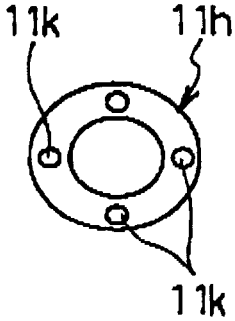

It is optional whether the collar 11*h* be formed with a slot 11*i* as in FIG. 14(*a*) or formed with V grooves 11*j* in circumferential positions of the collar 11*h* as in FIG. 14(*b*) or formed with through holes 11*k* at equal intervals in the collar 11*h* as in FIG. 14(*c*). According to the collar 11*h* shown in FIG. 14(*b*), when the collar is pinched by the edges 111*a* and 121*a*, there occurs a stress concentration in the V grooves 11*j*, resulting in the collar 11*h* being broken from near the V grooves 11*j*. The grooves 11*j* may be formed in the inner periphery of the collar 11*h* instead of forming them in the outer periphery of the collar. Further, the V grooves 11*j* may be substituted by U grooves. In the case of the collar 11*h* shown in FIG. 14(*c*), the portions where the through holes 11*k* are formed are lower in strength than the other portion, with consequent breakage of the collar 11*h* from near the portions where the through holes are formed.

Figure 15A:
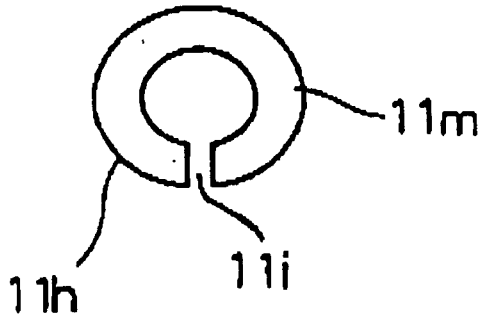
FIG. 15 shows another example of the collar illustrated in FIGS. 13(*a*) to 13(*c*), in which FIG. 15(*a*) is a plan view of a slotted collar provided with a binder layer, FIG. 15(*b*) is a side view thereof, and FIG. 15(*c*) is a side view showing a state in which the collar illustrated in FIG. 15(*b*) has been attached to the underside of a head portion of a blind rivet.
Figure 15B:
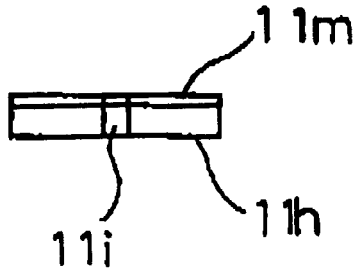
Figure 15C:
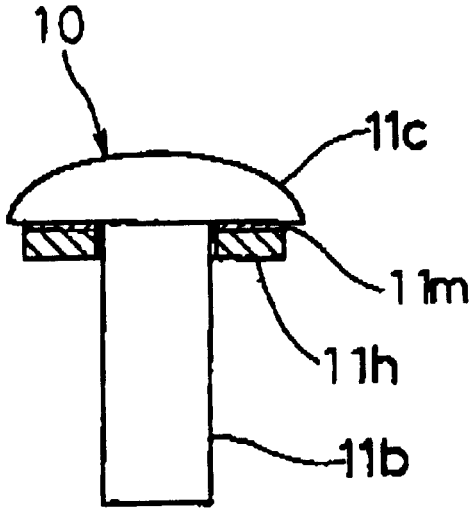

In FIGS. 15(*a*) to 15(*c*), a binder layer 11*m* is formed on an upper end face of the collar 11*h*. The binder layer 11*m* may be formed using a double-coated tape or may be formed using an adhesive. With the binder layer 11*m*, as shown in FIG. 15(*c*), the collar 11*h* can be adhered beforehand to the bottom of the head portion 11*c* of the blind rivet 10 and therefore it is not necessary that the collar 11*h* be fitted on the body portion 11*b* at every clamping of the blind rivet 10 to the base metals 1 and 2, thus making it possible to shorten the time required for the clamping work and prevent forgetting to fit the collar 11*h* on the body portion.

[Production Line for Disassembling Improperly Driven Rivet]

A description will be given below of a production system wherein a clamping member comprising a head portion and a body portion is inserted into clamping holes formed in base metals and is clamped to the base metals with the head portion of the clamping member being in contact with the peripheral edge portion of the clamping hole in one of the base metals, and in this state the clamping member is removed and the base metals are recovered.

Figure 16:
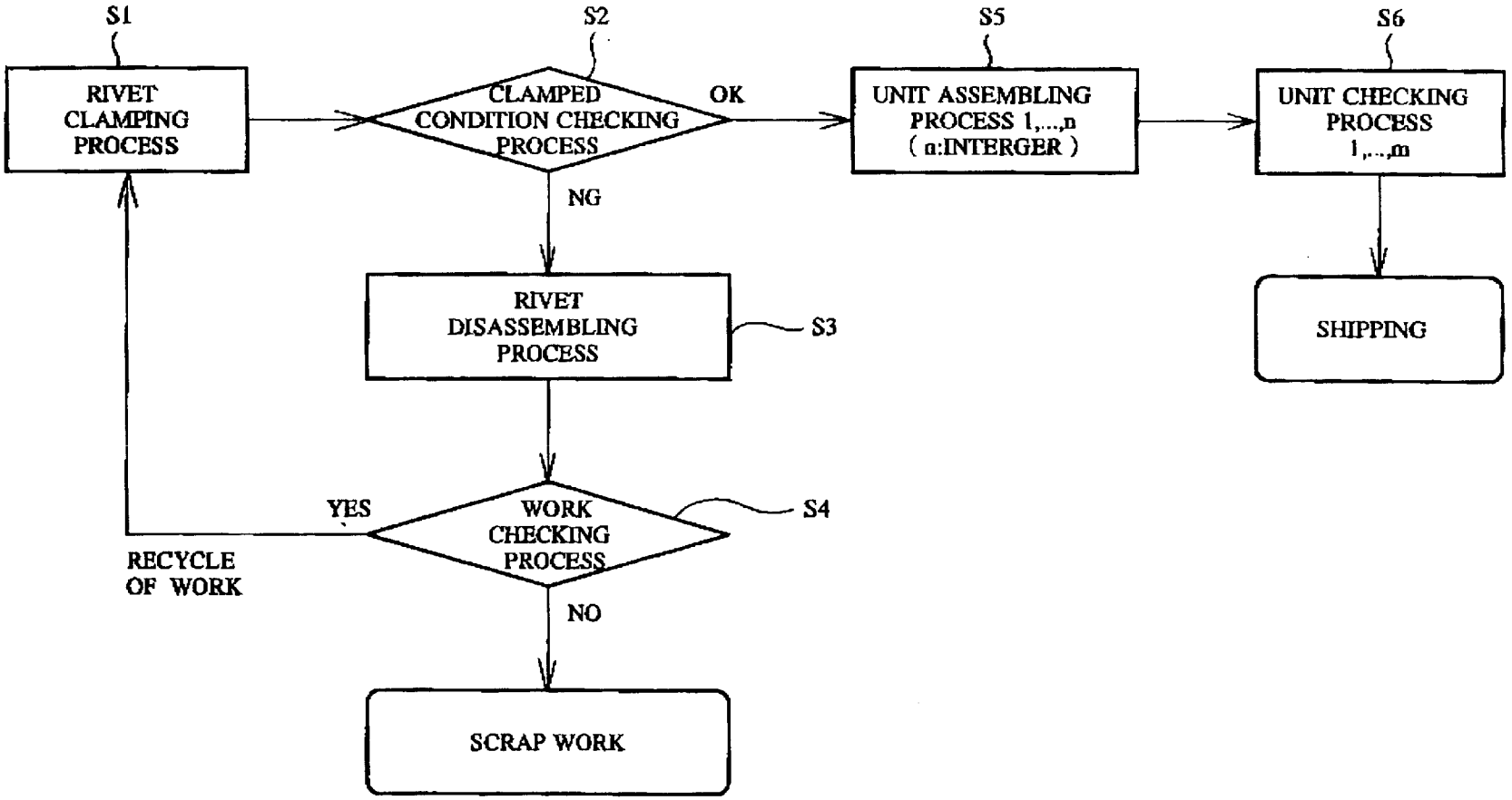
FIG. 16 is a flow chart for explaining a production system embodying the present invention, which involves removal of a clamping member from a base metal and subsequent recovery of the base metal.

Now, with reference to FIG. 16, the following description is provided about a process comprising checking a clamped condition of the clamping member to base metals, then in the case of the clamped condition being found to be unsatisfactory as a result of the checking, cutting off the head portion and the body portion of the clamping member from the boundary region and separating the two from each other, and recovering the base metals.

S.1 (Rivet Clamping Process)

At least two base metals (works) are clamped with a blind rivet by using a commercially available blind rivet clamping device 13.

S.2 (Clamped Condition Checking Process)

A check is made to see if, for example, a clearance is present between the blind rivet 10 clamped to the base metals in the rivet clamping process (S.1) and the works (base metals 1 and 2) (if the works are shaky or not) and if the blind rivet 10 is inclined with respect to the clamping hole surfaces of the works. This clamped condition checking process may be carried out simultaneously with the rivet clamping process (S.1).

S.3 (Rivet Disassembling Process)

If the blind rivet was found to be defective in the clamped condition checking process (S.2), the blind rivet 10 is removed from the work by using a blind rivet disassembling device (for example a disassembling device 100P using the existing rivet clamping device 13). This rivet disassembling process (S.3) may be carried out simultaneously with the clamped condition checking process (S.2). In the case where the clamped condition checking process (S.2) is carried out simultaneously with the rivet clamping process (S.1), the rivet disassembling process (S.3) may be performed simultaneously with the rivet clamping process (S.1).

S.4 (Work Checking Process)

If the works after disassembly in the rivet disassembling process (S.3) can be utilized again, a shift is made again to the rivet clamping process (S.1) to clamp the two works with a rivet.

On the other hand, if the works after disassembly in the rivet disassembling process (S.3) can no longer be utilized, the works are scrapped.

More particularly, if the clamping holes 1*a* and 2*a* were bent, damaged, or deformed, or if the works themselves were deformed, by the disassembling work in the rivet disassembling process (S.3), the works are scrapped.

S.5 (Unit Assembling Process)

The works judged to be satisfactory in their clamped condition in the clamped condition checking process (S.2) are fed to a unit assembling process on a production line. This unit assembling process comprises, say, n number of steps (n is an integer).

S.6 (Unit Checking Process)

The unit from the unit assembling process is then fed to a unit checking process, which comprises, say, m number of steps (m is an integer) and in which a check is made to see if the assembled condition is good or not and if performance is satisfactory or not. When the unit proved satisfactory in all the unit checking steps, it is shipped.

The processes in this production line may be carried out manually by workers or may be carried out automatically using a robot which is used in an automation line.

A production line associated with the blind rivet disassembling work for recycling products after recovery of the products may be constituted as follows.

When a product has been recovered from a user, works (base metals 1 and 2) with a blind rivet clamped thereto are disassembled by the disassembling device. When the disassembled works can be utilized again, the works are re-utilized. On the other hand, if the disassembled works cannot be re-utilized, the works are scrapped. If metallic works and resinous works are mixed together, these works should be subjected to a classifying work before their re-utilization, whereby the working efficiency is improved.

[Automatic Rivet Disassembling System for use in Production Line]

Figure 17:
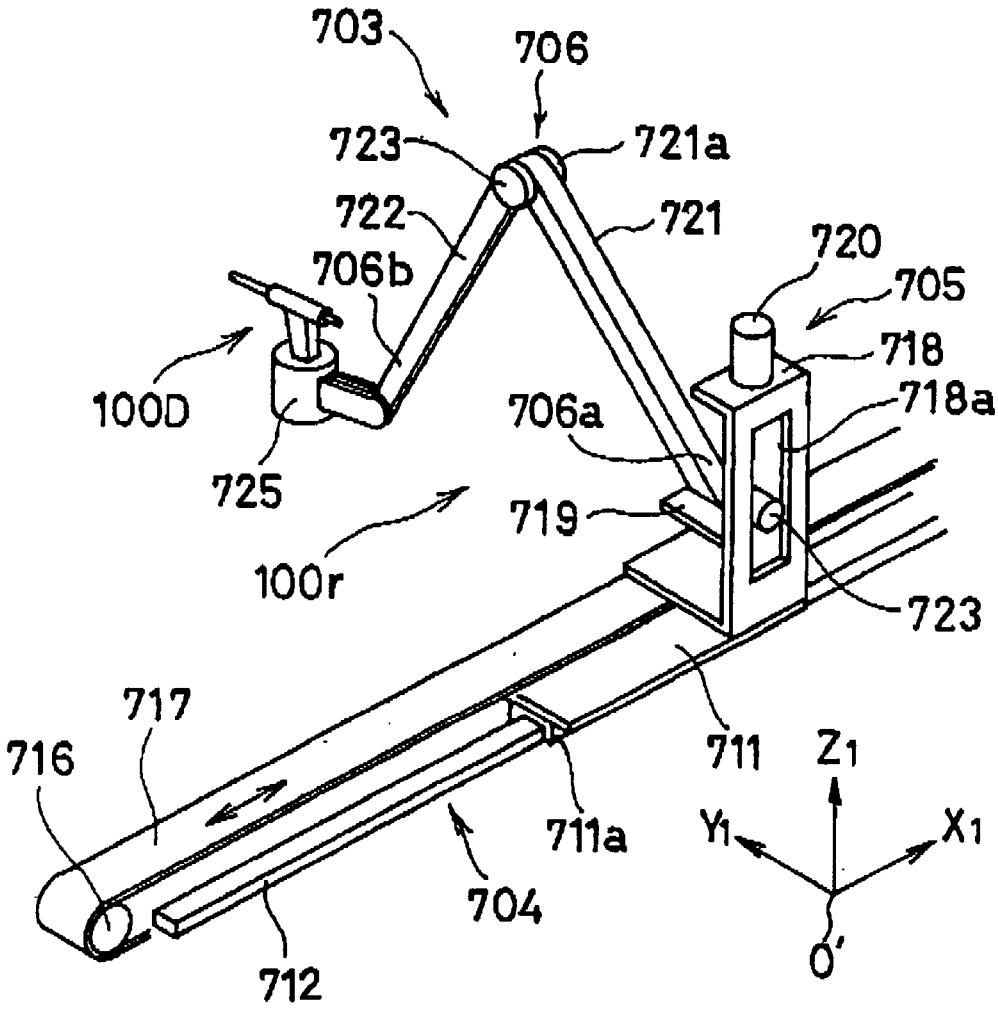
FIG. 17 is a perspective view showing a schematic construction of an automatic blind rivet disassembling system embodying the present invention.
Figure 18A:
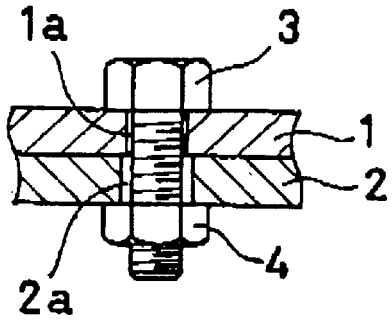
FIG. 18(a) (Prior Art)
FIG. 18(*a*) is an explanatory diagram showing a state in which base metals are clamped together using a bolt and a nut and FIG. 18(*b*) is an explanatory diagram showing a state in which base metals are clamped together using a tapping screw, both in accordance with conventional screw clamping techniques.
Figure 18B:
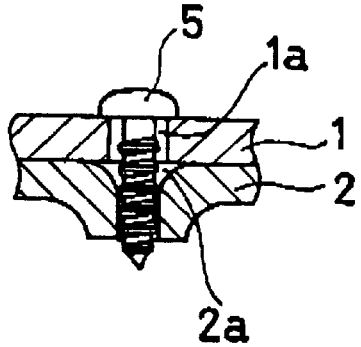
FIG. 18(b) (Prior Art)
Figure 19A:
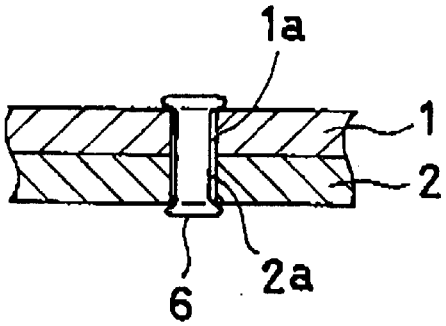
FIG. 19(a) (Prior Art)
FIG. 19(*a*) is an explanatory diagram showing a state in which base metals are clamped together by caulking both ends of a pin with use of a caulking machine and FIG. 19(*b*) shows a state in which an end portion of a shaft as a clamping member and a base metal are clamped together by caulking the shaft end portion, both in accordance with conventional pin clamping techniques.
Figure 19B:
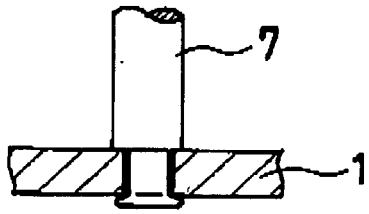
FIG. 19(b) (Prior Art)
Figure 20A:
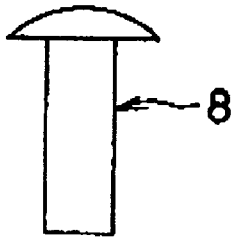
FIG. 20(a) (Prior Art)
FIG. 20 shows conventional rivet clamping techniques using rivets, in which FIG. 20(*a*) is an explanatory diagram showing a solid rivet, FIG. 20(*b*) is an explanatory diagram showing a tubular rivet, FIG. 20(*c*) is an explanatory diagram showing a blind rivet, FIG. 20(*d*) is an explanatory diagram showing a state in which base metals are clamped together using the solid rivet, FIG. 20(*e*) is an explanatory diagram showing a state in which base metals are clamped together using the tubular rivets, and FIG. 20(*f*) is an explanatory diagram showing a state in which base metals are clamped together using the blind rivet.
Figure 20B:
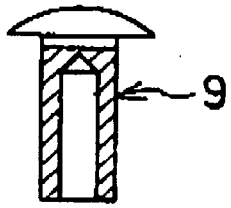
FIG. 20(b) (Prior Art)
Figure 20C:
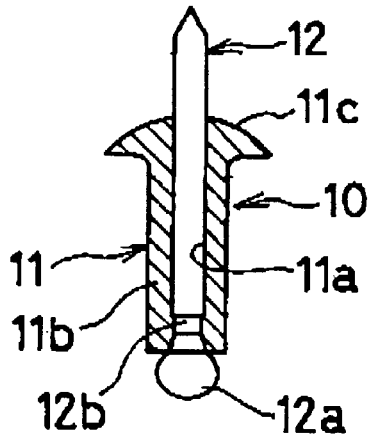
FIG. 20(c) (Prior Art)
Figure 20D:
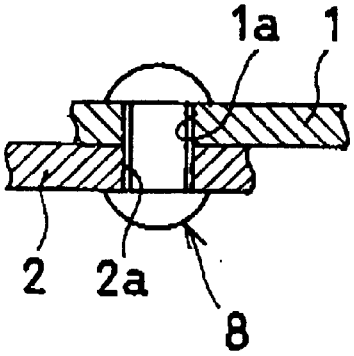
FIG. 20(d) (Prior Art)
Figure 20E:
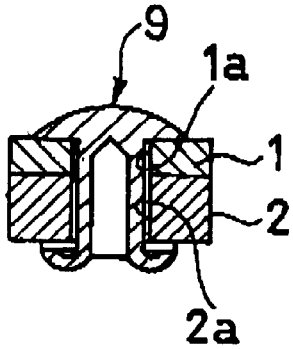
FIG. 20(e) (Prior Art)
Figure 20F:
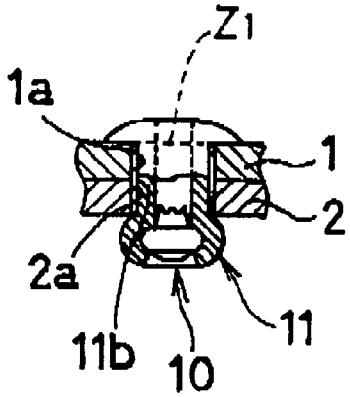
FIG. 20(f) (Prior Art)
Figure 21A:
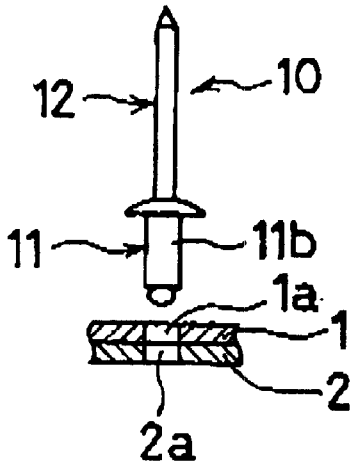
FIG. 21(a) (Prior Art)
FIG. 21 shows a conventional base metal clamping process using a blind rivet, in which FIG. 21(*a*) is an explanatory diagram showing a state just before insertion of the blind rivet into clamping holes formed in base metals, FIG. 21(*b*) is an explanatory diagram showing a state gripping an end portion of a mandrel of the blind rivet with use of a jaw member of a blind rivet clamping device, FIG. 21(*c*) is an explanatory diagram showing a state in which a stem portion of the mandrel has been gripped by the jaw member, and FIG. 21(*d*) is an explanatory diagram showing a state in which a projecting end of a body portion of the blind rivet has been caulked by breakage of the mandrel at a portion to be broken thereof which breakage is induced when the step portion of the mandrel is pulled by the jaw member.
Figure 21B:
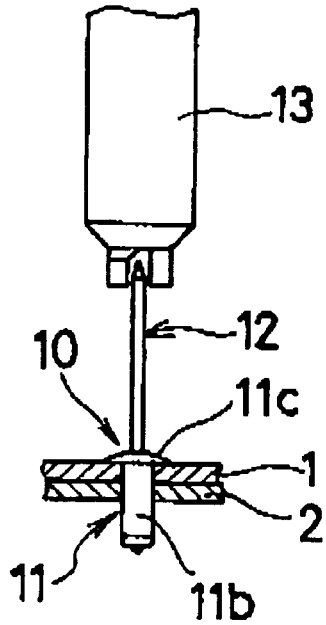
FIG. 21(b) (Prior Art)
Figure 21C:
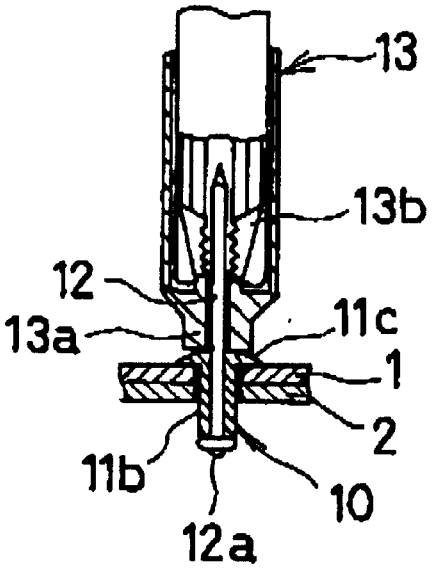
FIG. 21(c) (Prior Art)
Figure 21D:
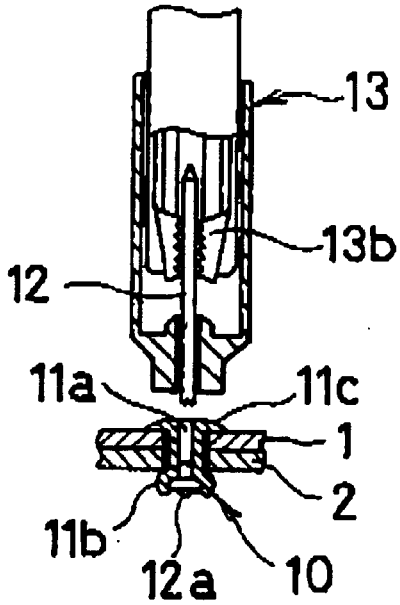
FIG. 21(d) (Prior Art)
Figure 22:
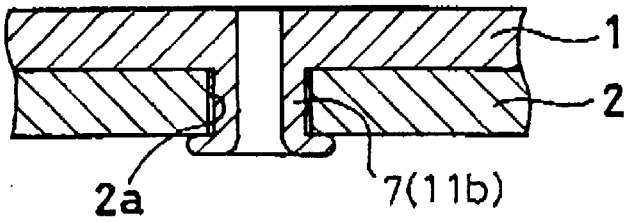
FIG. 22 (Prior Art)
FIG. 22 is a sectional view showing a conventional burring caulking technique.
Figure 23:
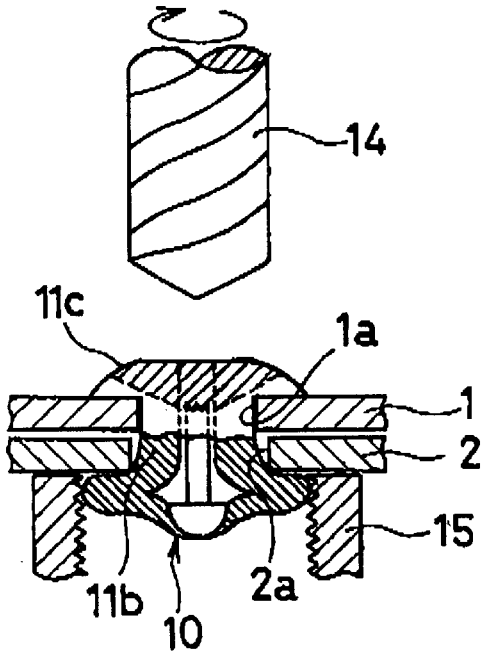
FIG. 23 (Prior Art)
FIG. 23 is a diagram showing a state in which a head portion of a blind rivet is cut with a drill to disassemble the blind rivet in accordance with a conventional disassembling method.
Figure 24:
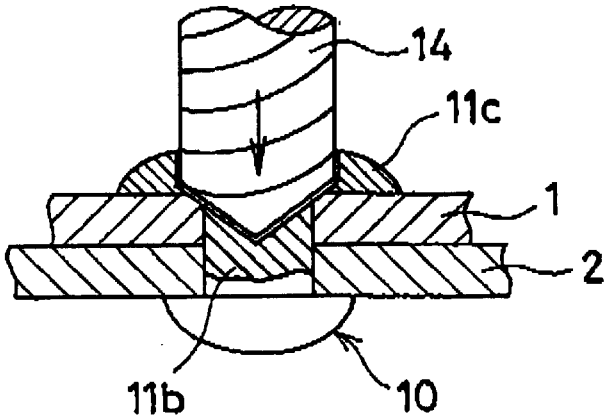
FIG. 24 (Prior Art)
FIG. 24 is a diagram for explaining an inconvenience involved in the conventional disassembling method using a drill.

As an automatic rivet disassembling system for use in this production line there is used, for example, a system of such a construction as shown in FIG. 17. This automatic rivet disassembling system will be described below.

The numeral 703 denotes a dual arm type robot system. The dual arm type robot system has a pair of arm mechanisms. Each arm mechanism comprises a first arm 704, a second arm 705 and a third arm 706. The first arm 704 comprises a base 711 which is moved by a belt drive unit (not shown) and a guide rail 712 which guides the base 711 while being engaged with a guide 711*a* formed in the base 711. The second arm 705 is connected onto the base 711 and is moved in the direction of coordinate axis X1 out of three predetermined coordinate axes X1, Z1 and Y1 which cross one another at origin O'.

Numeral 716 denotes a driven pulley in the belt drive unit and numeral 717 denotes a belt which is entrained on both a driving pulley (not shown) and the driven pulley 716 and which is fixed at both ends thereof to the base. The driving pulley is driven by a motor and the belt 717 is allowed to travel with rotation of the driving pulley. At the same time, the base 711 causes the second arm 705 to move in the coordinate axis X1 direction with a high accuracy while being guided by the guide rail 712.

The second arm 705 comprises a frame 718 fixed onto the base 711 of the first arm 704, a moving base 719 with a guide rod fitted in a slit 718*a* formed in the frame 718 and to which a base end portion 706*a* of the third arm 706 is fixed, and a motor 720 which causes a screw (not shown) threadedly engaged with the moving base 719 to rotate and thereby move the moving base 719. With rotation of the motor 720 the second arm 705 causes the third arm 706 to move in the coordinate axis Z1 direction together with the moving base 719.

A male screw of the moving base 719 threadedly engaged with the screw which is rotated by the motor 720 is constituted by a ball screw containing a large number of balls so that the moving base 719 moves with smooth and high accuracy. The guide rod is provided for preventing rotation of the moving base 719. The third arm 706 comprises a first arm member 721 having a base end portion 706*a* at one end thereof, the base end portion 706*a* being fixed to the moving base 719 of the second arm 705 and thereby connected to the second arm, a second arm member 722 having a front end portion 706*b* as one end opposite to the base end portion 706*a*, and a joint portion 723 which connects the opposite end of the second arm member 722 to the opposite end of the first arm member 721 and which causes the second arm member 722 to turn relative to the first arm member 721. The third arm 706 causes the front end portion 706*b* to move in the coordinate axis Y1 direction out of the three predetermined coordinate axes X1, Z1 and Y1 through the joint portion 723. The front end portion 706*b* of the third arm 706 is provided with a hand portion 725, to which the blind rivet disassembling device 100D is attached.

The dual arm type robot system 703 is controlled automatically by a computer, whereby in the event the base metals 1 and 2 should be found defective in their clamped condition in the production line, the blind rivet is disassembled automatically in accordance with the flow chart of FIG. 16. In cutting the blind rivet, the blades driving shaft, or a push-out pin, 140 is admitted into the through hole of the blind rivet interlockedly with the blades 111 and 121.

According to the disassembling device and method of the present invention, since the head portion and the body portion of the clamping member are cut off from each other by a cutting operation, there is no likelihood that the clamping member may turn idle, nor is there any fear of damage to the base metals.

According to the attachment structure of the present invention, the clamping member can be disassembled using an existing blind rivet clamping device.

According to the production system of the present invention, the recovery of base metals can be done easily.

Although the invention has been described in its preferred form with a certain degree of particularity, obviously many changes and variations are possible therein. It is therefore to be understood that the present invention may be practiced otherwise than as specifically described herein without departing from the scope and spirit thereof.

What is claimed is:

1. A clamping member disassembling device for disassembling a clamping member from base metals, the clamping member having a head portion and a body portion and being clamped to the base metals, with the body portion being inserted into clamping holes formed in the base metals and the head portion being in contact with a peripheral edge portion of the clamping hole in one of the base metals, said clamping member disassembling device comprising:

a cutting means for cutting the body portion of the clamping member in a direction nearly perpendicular to an axial direction of the body portion;

a moving means for advancing and retreating said cutting means in the axial direction of the body portion; and an actuation means for actuating said cutting means in a direction nearly perpendicular to the axial direction of the body portion with an advancing and retreating motion of said cutting means.

2. A clamping member disassembling device according to claim 1, further including a keeping means for keeping said cutting means at a certain position in the axial direction of the body portion of the clamping member when the body portion is cut by the cutting means.

3. A clamping member disassembling device according to claim 1, further including a pulling means which pulls the head portion of the clamping member using said cutting means away from the body portion in the axial direction of the body portion while the body portion is gripped by said cutting means in a cutting work.

4. A clamping member disassembling device for disassembling a clamping member from base metals, the clamping member having a head portion and a body portion and being clamped to the base metals, with the body portion being inserted into clamping holes formed in the base metals and the head portion being in contact with a peripheral edge portion of the clamping hole in one of the base metals, said clamping member disassembling device comprising:

a cutting means for cutting the clamping member; and an actuator for actuating said cutting means, wherein said cutting means comprises blades for cutting a boundary region of the clamping member oriented perpendicular to an axial direction of the body portion and positioned between the body portion and the head portion, the blades cutting the boundary region in opposite directions with respect to the axis of the body portion, a grip portion substantially integral with said blades and adapted to cause the blades to substantially advance and retreat in unison with advancing and retreating motions of said actuator while being gripped by the actuator, and a motion changing means for changing the motion of said blades into an opening or closing motion in directions nearly perpendicular tot he axial direction of the body portion of the clamping member with an advancing or retreating motion of the blades, and said actuator causes said cutting means to advance and retreat while gripping said grip portion to separate the head portion and the body portion from the boundary region.

5. A clamping member disassembling device according to claim 4, further comprising a contact/holding means, said contact/holding means having a contact portion for contact with the head portion of the base metals and also having a fixed portion fixed substantially to a body of the disassembling device, said contact/holding means being adapted to hold the body of the disassembling device at a predetermined position relative to the base metals, thereby allowing said blades to cut the boundary region and allowing the head portion to be pulled in a direction toward the disassembling device body.

6. A clamping member disassembling device according to claim 4, wherein said motion changing means is substantially integral with said grip portion, and said cutting means possesses elasticity and has an outer peripheral surface formed as an inclined surface which is inclined outward in a direction in which said blades are present.

7. A clamping member disassembling device according to claim 4, wherein said motion changing means is substantially integral with said grip portion.

8. A clamping member disassembling device according to claim 7, wherein said cutting means possesses elasticity and has an outer peripheral surface formed as an inclined surface which is inclined outward in a direction in which said blades are present.

9. An attachment structure comprising an attachment unit adapted for attachment to a blind rivet clamping device to disassemble a blind rivet, in which a body portion of the blind rivet integral with a head portion of the blind rivet is inserted into clamping holes formed in base metals and a mandrel of the blind rivet is gripped and pulled by the clamping device to clamp the blind rivet, said attachment unit comprising:

a cutting means for cutting a boundary region between the body portion and the head portion of the blind rivet from both sides toward an axial direction of the body portion, the boundary region being substantially perpendicular to the axial direction of the body portion;

a grip means for gripping an actuator of the blind rivet disassembling device so as to cause said cutting means to advance and retreat in the axial direction of the boy portion; and an actuation means for actuating said cutting means in a direction nearly perpendicular to the axial direction of the body portion with an advancing and retreating motion of said grip means.

10. An attachment structure according to claim 9, further including a keeping means for keeping said cutting means at a certain position in the axial direction of the body portion when the body portion is cut by said cutting means.

11. An attachment structure according to claim 9, further comprising a pulling means which pulls the head portion using said cutting means away from the body portion in the axial direction of the body portion while the body portion is gripped by said cutting means in a cutting work.

12. An attachment structure comprising an attachment unit attached to a blind rivet clamping device for disassembling the blind rivet, in which a body portion of the blind rivet integral with a head portion of the blind rivet is inserted into clamping holes formed in base metals and a mandrel of the blind rivet is gripped and pulled by said clamping device to clamp the blind rivet, wherein said blind rivet clamping device having an actuator for actuating said attachment unit, said attachment unit having a cutting means for cutting the blind rivet, said cutting means comprises blades for cutting a boundary region of the clamping member oriented perpendicular to an axial direction of the body portion and positioned between the body portion and the head portion, the blades cutting the boundary region in opposite directions with respect to the axis of the body portion, a grip portion substantially integral with said blades and adapted to cause said blades to substantially advance and retreat in unison with advancing and retreating motions of said actuator while being gripped by said actuator, and a motion changing means for changing the motion of said blades into an opening or closing motion in directions nearly perpendicular to the axial direction of the body portion with an advancing or retreating motion of the blades, and said actuator causes said cutting means to advance and retreat while gripping said grip portion to separate the head portion and the body portion from the boundary region.

13. An attachment structure according to claim 12, wherein said attachment unit further comprises a contact/holding means having a first contact portion and a second contact portion, said first contact portion being adapted to contact one of the base metals to fix said cutting means, said second contact portion being brought into engagement with a front end of the blind rivet clamping device, allowing said cutting means to be substantially fixed to said blind rivet clamping device, and said cutting means pulls the head portion of the blind rivet toward said blind rivet clamping device while cutting the boundary region.

14. An attachment structure according to claim 12, wherein said motion changing means is substantially integral with said grip portion, and said cutting means possesses elasticity and has an outer peripheral surface formed as an inclined surface which is inclined outward in a direction toward said blades.

15. An attachment structure according to claim 12, wherein said motion changing means is substantially integral with said grip portion.

16. An attachment structure according to claim 15, wherein said cutting means possesses elasticity and has an outer peripheral surface formed as an inclined surface which is inclined outward in a direction toward said blades.

17. A production system wherein a clamping member having a head portion and a body portion and clamped to base metals, with the body portion being inserted into clamping holes formed in the base metals and the head portion being in contact with a peripheral edge portion of the clamping hole in one of the base metals, is removed and the base metals are recovered, said production system comprising a clamping member disassembling device, said clamping member disassembling device comprising:

a cutting means for cutting off the body portion in a direction nearly perpendicular to an axial direction of the body portion;

a moving means for advancing and retreating said cutting means in the axial direction of the body portion; and an actuation means for actuating said cutting means in a direction nearly perpendicular to the axial direction of the body portion with an advancing and retreating motion of the cutting means, and wherein the clamped condition of the clamping member to the base metals is checked and if it is found to be defective the clamping member is removed from the base metals using the clamping member disassembling device and the base metals are recovered.

18. A production system wherein a clamping member having a head portion and a body portion and clamped to base metals, with the body portion being inserted into clamping holes formed in the base metals and the head portion being in contact with a peripheral edge portion of the clamping hole in one of the base metals, is removed and the base metals are recovered, said production system comprising a clamping member disassembling device, said clamping member disassembling device comprising:

a cutting means for cutting off the body portion in a direction nearly perpendicular to an axial direction of the body portion;

a moving means for advancing and retreating said cutting means in the axial direction of the body portion; and an actuation means for actuating said cutting means in a direction nearly perpendicular to the axial direction of the body portion with an advancing and retreating motion of said cutting means;

wherein the clamping member is removed from the base metals using the clamping member disassembling device and the base metals are recovered.

19. A clamping member disassembling device for disassembling a clamping member from first and second base members, the clamping member having a head portion and a body portion that is connected to the first base member and extends through a hole formed the second base member, the head portion is in contact with a peripheral edge of the hole, said disassembling device comprising:

an actuation surface;

a cutting device having a plurality of actuatable blades configured to be positioned on opposing sides of the head portion of the clamping member; and an actuator configured to provide relative movement between the cutting device and the actuation surface in a direction parallel to an axial direction of the body portion of the clamping member, such that when the actuation surface and the cutting device contact the plurality of blades are forced towards each other and join along a cutting axis that is perpendicular to the direction of relative movement.

20. The clamping member disassembling device of claim 19, wherein the plurality of blades includes a first blade and a second blade configured to slide in relation to one another in a direction perpendicular to the axial direction of the body portion of the clamping member.

21. The clamping member disassembling device of claim 20, wherein the first blade and the second blade are biased away from one another by a biasing device.

22. The clamping member disassembling device of claim 19, wherein the plurality of blades include a first blade and a second blade pivotally joined together such that the first blade and the second blade are configured to move in relation to one another in a direction perpendicular to the axial direction of the body portion of the clamping member.

23. The clamping member disassembling device of claim 22, wherein the first blade and the second blade are integrally connected to form a unit, said unit being elastically deformable to provide for pivotal movement between the first blade and the second blade.

24. The clamping member disassembling device of claim 19, wherein the cutting device includes an inclined surface configured to contact the actuation surface.

25. The clamping member disassembling device of claim 19, wherein the actuation surface is an inclined surface configured to contact the cutting device.

26. The clamping member disassembling device of claim 19, wherein the actuator is slidably received within a housing and the actuator is connected to the cutting device to provide for movement of the cutting device in relation to the actuation surface.

27. The clamping member disassembling device of claim 19, wherein:

the actuator includes a shaft slidably received within a housing;

the shaft has a terminal end with a engaging portion; and the shaft extends through the cutting device such that the engaging portion engages with the cutting device.

28. The clamping member disassembling device of claim 27, wherein:

the actuator further includes an actuation device mounted to the housing and a clamping device;

the actuation device is configured to provide sliding movement of the clamping device in a direction parallel to the axial direction of the body portion of the clamping member; and the clamping device is configured to releasably clamp the shaft.

29. The clamping member disassembling device of claim 19, wherein:

the actuation surface is an engaging pin projecting from a portion of the actuator;

the plurality of blades includes a first blade pivotally connected at a fixed first position to a blade holding member and having a first guide hole receiving the engaging pin; and the plurality of blades includes a second blade pivotally connected at a fixed second position to a blade holding member and having a second guide hole receiving the engaging pin.

30. The clamping member disassembling device of claim 19, further comprising a contact/holding member connected to a housing including the actuation surface, the contact holding member including a contact portion configured to contact the second base member.

31. The clamping member disassembling device of claim 30, wherein the contact/holding member is detachably connected to the housing via mating screw threads.

32. The clamping member disassembling device of claim 19, wherein:

the actuator includes a shaft slidably received within a housing and connected to the cutting device; and the actuator includes an air cylinder mounted to the housing and configured to move the shaft in a direction parallel to the axial direction of the body portion of the clamping member.

* * * * *